US010533733B1

(12) United States Patent
Dewey

(10) Patent No.: US 10,533,733 B1
(45) Date of Patent: Jan. 14, 2020

(54) MULTI-FUNCTION TOOL, KIT, AND METHODS OF USING THE SAME

(71) Applicant: About Time, LLC, Waverly, IA (US)

(72) Inventor: Scott Dewey, Waverly, IA (US)

(73) Assignee: About Time, LLC, Waverly, IA (US)

( * ) Notice: Subject to any disclaimer, the term of this patent is extended or adjusted under 35 U.S.C. 154(b) by 0 days.

(21) Appl. No.: 16/279,755

(22) Filed: Feb. 19, 2019

Related U.S. Application Data

(60) Provisional application No. 62/633,498, filed on Feb. 21, 2018.

(51) Int. Cl.

| | |
|---|---|
| ***B25B 23/18*** | (2006.01) |
| ***F21V 21/088*** | (2006.01) |
| ***F21L 4/04*** | (2006.01) |
| ***H01R 11/24*** | (2006.01) |
| *F21Y 115/10* | (2016.01) |

(52) U.S. Cl.
CPC ..... *F21V 21/0885* (2013.01); *F21L 4/04* (2013.01); *H01R 11/24* (2013.01); *F21Y 2115/10* (2016.08)

(58) Field of Classification Search
CPC ..... F21L 4/00–085; F21V 21/08–0965; H01R 11/11–32
USPC ..... 362/109, 119–120, 253, 396, 398
See application file for complete search history.

(56) References Cited

U.S. PATENT DOCUMENTS 7,222,996 B2 * 5/2007 Lin ..... F21S 8/00 362/132

* cited by examiner

*Primary Examiner* — Jason M Han
(74) *Attorney, Agent, or Firm* — McKee, Voorhees & Sease, PLC

(57) ABSTRACT

A multi-use tool of small form factor such as can be used for at least clipping an object, clipping to an object, retaining another object. Additional embodiments can include magnetic mounting and/or task lighting. A plurality of such tools could be used for trail marking by using a plurality clipped, mounted, or even dropped along a path. The multi-use tool with a light source can include illumination or trail marking plus different mounting features. One is a clamp. Another is a magnetic mount. All these features can be integrated into a single disposable assembly.

11 Claims, 42 Drawing Sheets

MULTI-FUNCTION TOOL, KIT, AND METHODS OF USING THE SAME

CROSS-REFERENCE TO RELATED APPLICATIONS

This application claims the benefit of provisional application Ser. No. 62/633,498, filed Feb. 21, 2018, which application is incorporated by reference in its entirety.

I. BACKGROUND OF THE INVENTION

A. Field of the Invention

The present invention relates to self-contained, multi-function tools and assemblies and, in particular, to small form factor but multi-function assemblies.

This invention relates to a multi-use/multi-function assembly that can take on different forms and embodiments. In one form, a multi-function holder tool includes a pair of clamping jaws having distal ends which are constantly urged into abutment by a spring or similar force to allow clipping or clamping to another object or holding an object, plus an intentional space between and behind the clamping jaws to allow capture and retainment of such things as key rings, D-rings, straps, rods, and branches to retain such other objects or retain the tool to other objects with or without use of the clamping action of the clamping jaws at the distal end of the tool. Another embodiment includes the clamp and retainer as described above but adds a magnet for a still further mounting functionality. Another embodiment includes the clamp and retainer described above but adds an on-board mini light to add a task light or marker light functionality.

B. Related Art

The state-of-the-art is crowded with tools to assist humans with different functions. Many are hand-held size or smaller. They include one-function tools such as clips to hold notes or small parts, rings to retain one or more small objects such as keys, thumb drives, identification cards or badges, or small flashlights.

The state-of-the-art of portable illumination sources is generally some type of self-contained light source, like the flashlight. For adequate illumination of a substantial area or to substantial distances, this tends towards at least a palm-sized form factor, sufficient light output (which many times requires an incandescent source or multiple LEDs), and an on-board power source (battery or batteries). This tends to increase the size, weight, and volume of such multi-LED, xenon, or incandescent task lights. Another advantage of larger form factors is easier handling and aiming. But these sizes, of course, come at a cost in materials and manufacturing.

There have been attempts to add other functions to hand-held flashlights. Examples are pen lights. Pen lights have a pen-like form factor and pocket clip. Also, they tend to have replaceable batteries. They may use just one small light source and a clip to clip-on the device to a shirt pocket. But they are limited to clipping to a thin material such as cloth.

There have been attempts to combine functions in other small tools. Examples combine magnets with clips, tethers, or carabiners for mounting the device to a metal surface and holding or retaining another object. However, magnets are limited to a metal surface for mounting. Tethers or carabiners do not require a metal surface and require hanging and do not allow fixed aiming.

Thus, as indicated above, there are competing, and sometimes antagonistic, factors in designing multi-function small tools. There are similar competing factors when designing small task lights. One set of factors is size, weight, and materials. Another is mounting methods, if any, for hands-free use. Another is light type, intensity, distribution, output and power source.

The inventors have identified a need in the state-of-the-art. The solution is for multi-use/function small tool or assembly. Some embodiments include a mini-light that combines not only a relatively bright task light but also different ways to mount to different types of mounting surfaces or objects, including at least in certain mounting states while maintaining an aiming direction. There are competing interests in doing so. For example, building-in multiple functions to a small form factor is not trivial. The arrangement and cooperation of functional features of a multi-function assembly in a small form factor is not trivial. The ability to produce reasonably effective task lighting from a small form factor is not trivial, nor is the ability to mount the whole assembly to a variety of form factors and types.

A variety of clips or holders are commercially available. There are magnetic mounts that include clamps or clips. But the clamp or clip is typically configured for one retaining function, usually clamping action on a piece of paper or photograph.

There are retainers for such things as D-rings, key-rings, straps, and other relatively small cross-sectional diameter objects. One example is a carabiner. It is basically a closed loop with a section that can be pivoted open to allow passage of the ring or strap, and then closed to retainer within the loop. But this is limited to a retaining function and requires manual dexterity to open and close.

Therefore, room for improvement has been identified in this technical area.

II. SUMMARY OF THE INVENTION

A. Objects, Features, and Advantages

It is therefore principal object, feature, aspect, or advantage of the present invention to improve over or solve problems and deficiencies in the state-of-the-art.

Further objects, features, and advantages of the invention include an apparatus or system which has a one or more of the following features:

a. A relatively small form factor, for example, smaller at least in length than a pen light.
b. Self-contained, including an electrical power source if a mini-light is included.
c. Multiple functions including a clip-on function and a retaining function. Some embodiments had a magnetic-mount function and/or an illumination function.
d. An aesthetic that is balanced between the multi-functions.
e. Can be used for a variety of environments, including in and out of doors, and applications. If the light function is included, uses include but are not limited to task lighting and trail-marking/fiducial markers using a plurality of the assemblies.
f. As a kit can include a plurality of the multi-function assemblies so that one or more can be used and available.

g. If the clip and retaining functions, as well as the light and magnet functions are all included, the tool serves the problem of being able to add light to almost any situation hands free. For example, the magnet and the clip allow the light output of the apparatus to be attached and directed to a point of use.

h. If the light function is included, use in almost any situation where additional light is needed. For example, with just the flip of a switch to turn on for light, and a quick and easy clip or stick (if an eligible surface is available) where needed.

i. With the clip and retaining multi-functions, either clamping action of opposing jaws on one or more objects is possible alone or retaining another object or objects in the gap behind the clamping jaws, or both are possible. This allows such things as retaining a ring of keys in the retainer gap while at the same time gripping a note in the clamping jaws.

B. Aspects of the Invention

A first aspect of the invention is a multi-use/function mini-light assembly. The assembly includes:

a. a housing, b. one end of the housing comprising a task light including:

i. an LED light source where the light source can function reasonably for task lighting and trail marking, ii. a battery installed in the housing, iii. a circuit which can be switched to activate the LED manually on demand, c. an opposite end of the housing comprising mounting features including:

i. a spring-loaded or otherwise adjustable clamp for mounting the assembly by clamping action, where the clamp has integrated into it ability to clamp on relatively thin or planar objects such as paper, cloth, boards, plates, and the like, whether more rigid or more flexible in nature, but also at least be secured to more elongated objects such as tree or plant branches, rods, ropes/cables, and the like, and an easy-to-use angled grip to actuate the clip, ii. a gap behind or in-board of the clamp configured to retain a variety of objects including but not limited to rings, straps, whether or not an object is clamped in the clamp; and d. a magnet to mount the assembly to metal or ferro-magnetic surfaces.

In one embodiment, the light source is a single LED with an emission angle at one end of the assembly. The clamp is a set of clamping jaws at the opposite end of the housing with a manually-operable handle for opening the jaws of the clamp against the restoring force of a resilient member. The gap is behind the jaws and presents an open area both when the jaws are closed or opened and is sized to receive through it items having a cross-sectional area on the order of key rings, D-rings, some dog collars, book bag handles, or similar. The magnet is installed along the side of the assembly. The assembly and the multi-use/function arrangement of the assembly is on a small-form-factor-scale of millimeters-in-width and centimeters-in-length with a relatively economical cost of production. In some cases, it can be considered for disposable use.

Another aspect of the invention is a kit of plural such assemblies. Packaged in the kit as a set, the individual assemblies can be used individually one-at-a-time or two or more concurrently or collectively. One example of collectively is to use a plural of assemblies, turn each on, and then mark a trail so that it can be followed in the dark. Another collective use is to easily mount several assemblies at the same or relatively same aiming direction directions to help illuminate a task area.

Another aspect of the invention is a small tool or assembly including just the clamping and retaining functions as discussed above. The combination provides the subtle but valuable multi-functional options of clamping/gripping and/or retaining. In particular, the retaining is of objects or items having a cross-sectional area at the retaining gap on the order of that of a key ring or some dog collars or book bag handles. The retainer gap resists movement out of the gap, including when the clamping jaws are gripping an object. The assembly includes:

a. a clip comprising mounting features including:

i. a spring-loaded or otherwise adjustable clamp for mounting the assembly by clamping action, where the clamp has integrated into it ability to clamp on relatively thin or planar objects such as paper, cloth, boards, plates, and the like, whether more rigid or more flexible in nature, but also at least be secured to more elongated objects such as tree or plant branches, rods, ropes/cables, and the like, and an easy-to-use angled grip to actuate the clip, and ii. a gap behind or in-board of the clamp configured to retain a variety of objects including but not limited to rings, straps, whether or not an object is clamped in the clamp.

Optionally, a magnet can be included on the assembly to mount the assembly to metal or ferro-magnetic surfaces.

In one embodiment, the combination of clamping and retaining functions includes a set of jaws that are constantly urged into abutment and the gap is defined by parts of both jaws but behind them. When the jaws are in abutment and thus closed, the gap exists and has is defined by an enclosing edge. Another retained in the gap thus faces a mechanical stop in any direction unless the jaws are opened. The gap has an area through it so that it can receive and retain, without clamping, items such as typical key rings and other loops or rings, but also multiple such rings or single items of larger cross-section such as oblate or rectangular dog collars, book bag straps, or other similar form factors. In one embodiment, the gap has features that enhance resistance of movement of a retained item from the gap, including in the direction of the jaws. In one example, the gap is off-center from the plane through the jaws. Therefore, retained objects that are pulled by forces (manual, gravity, or other) towards the abutting jaws will at least primarily contact a continuous part of the edge of the gap and not at the plane between the jaws.

These and other objects, features, aspects, and advantages of the invention will become more apparent with reference to the accompanying description, drawings, and claims.

III. BRIEF DESCRIPTION OF THE DRAWINGS

Figure 9A:
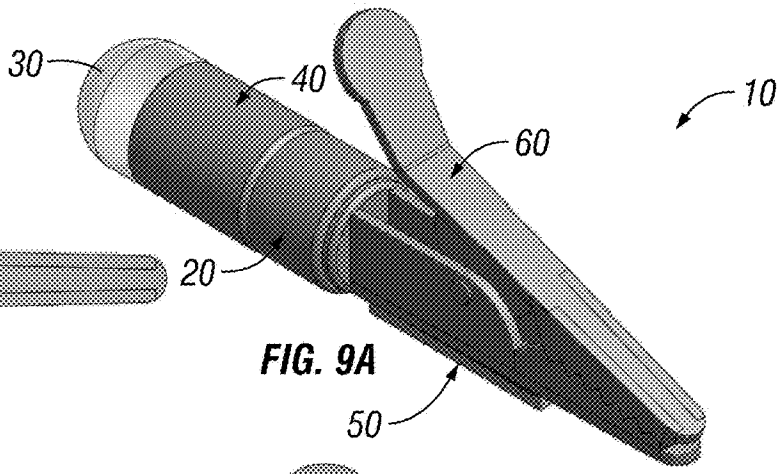
FIG. 9A is a perspective solid-body view of an embodiment similar to FIG. 1A from a still further viewing direction. Exemplary dimensions are in inches.
Figure 9F:
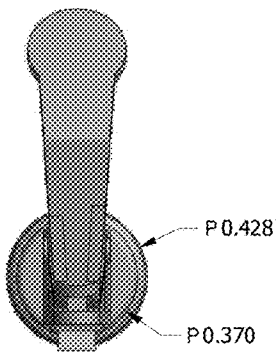
Figure 9D:
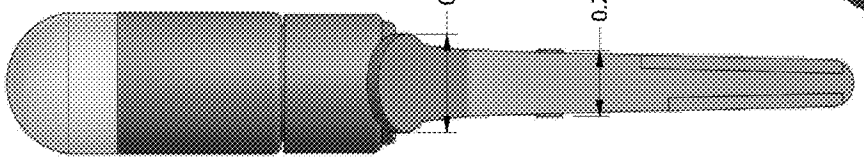
Figure 9B:
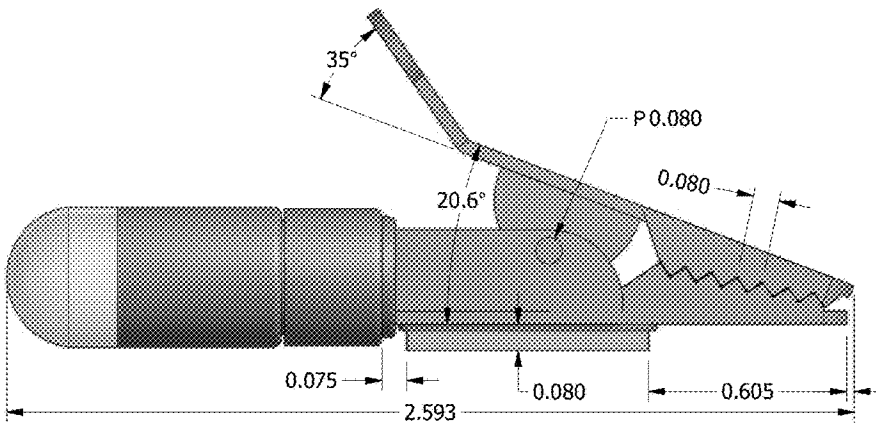
Figure 9C:
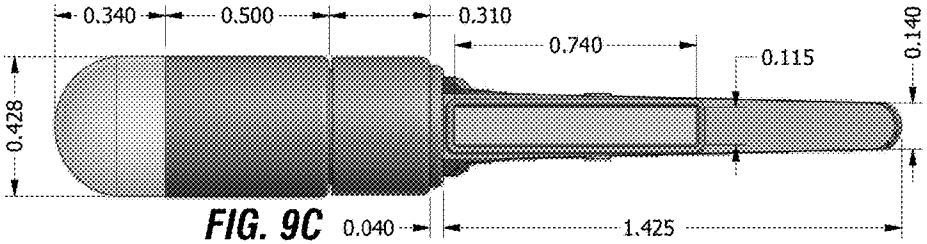
Figure 9E:
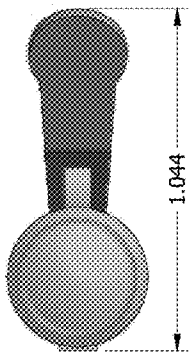
Figure 9G:
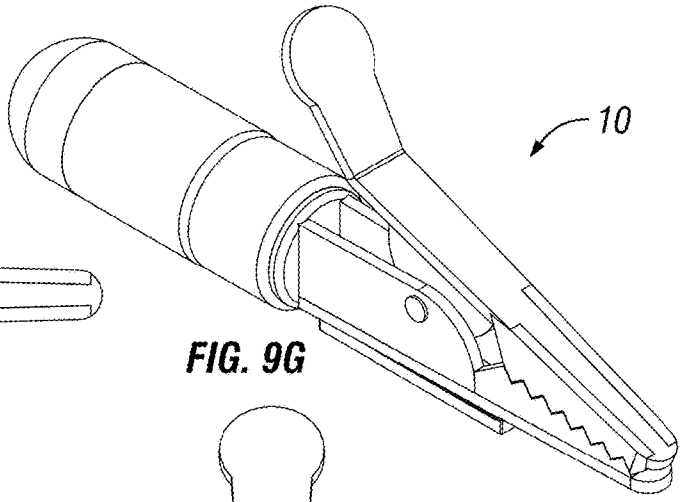
Figure 9L:
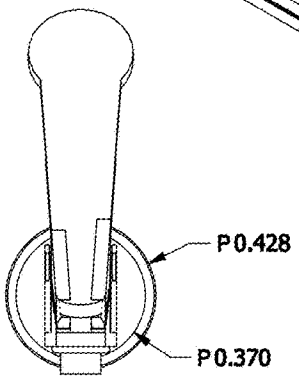
Figure 9J:
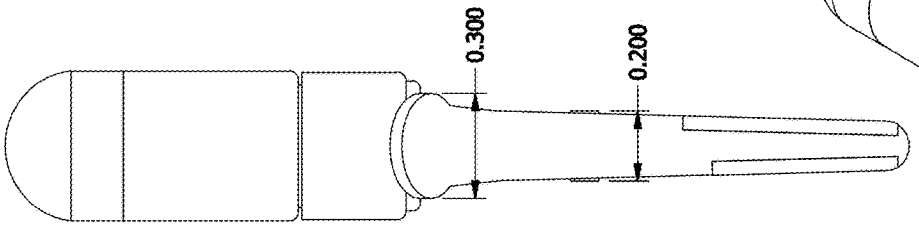
Figure 9H:
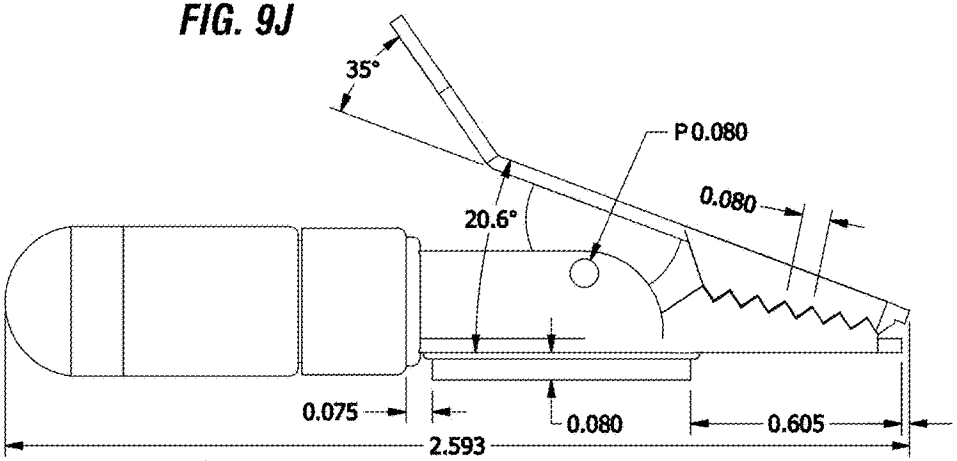
Figure 9I:
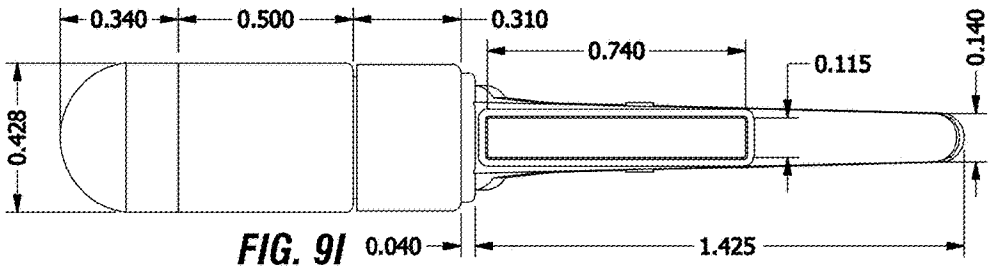
Figure 9K:
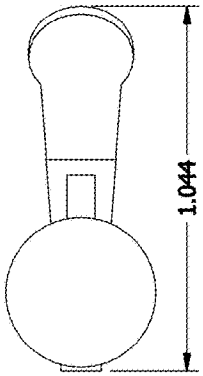

FIGS. 9B-F are isometric side elevation (the opposite side is a mirror image), bottom plan, top plan, one end elevation, and opposite end elevation, respectively, of the apparatus of FIG. 9A. Exemplary dimensions are in inches.

FIGS. 9G-L are solid-body views similar to FIGS. 9A-F but are line drawings. Exemplary dimensions are in inches.

Figure 10A:
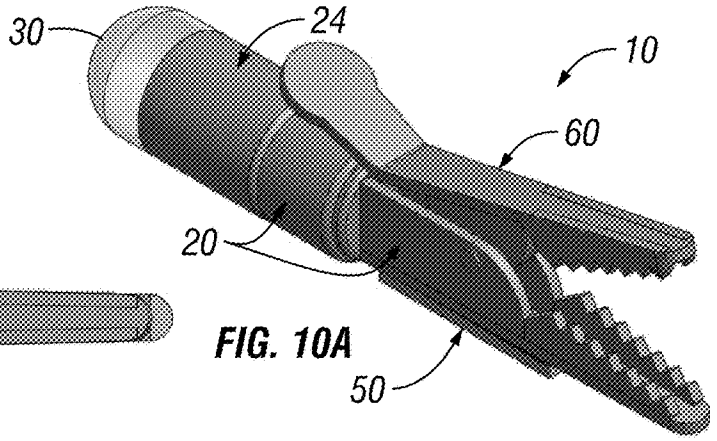
Figure 10D:
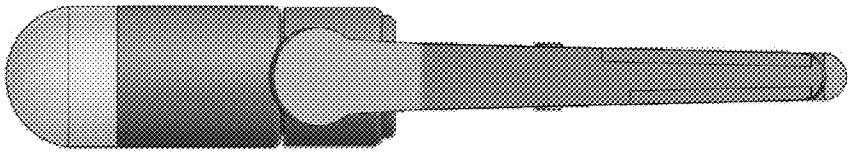
Figure 10B:
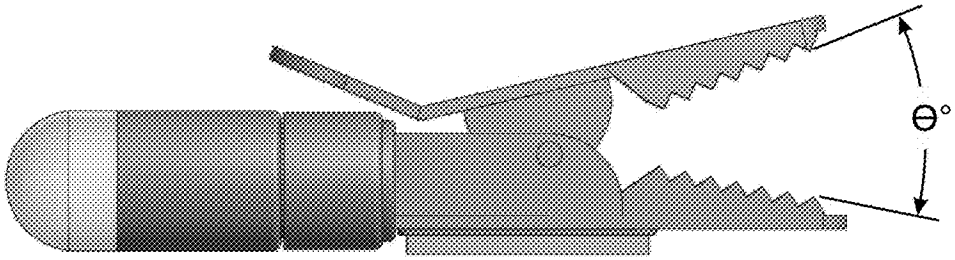
Figure 10C:
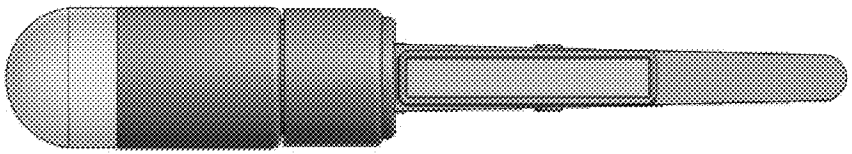
Figure 10F:
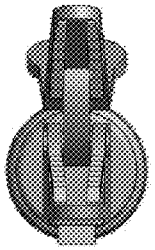
Figure 10E:
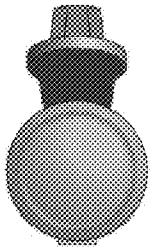
Figure 10G:
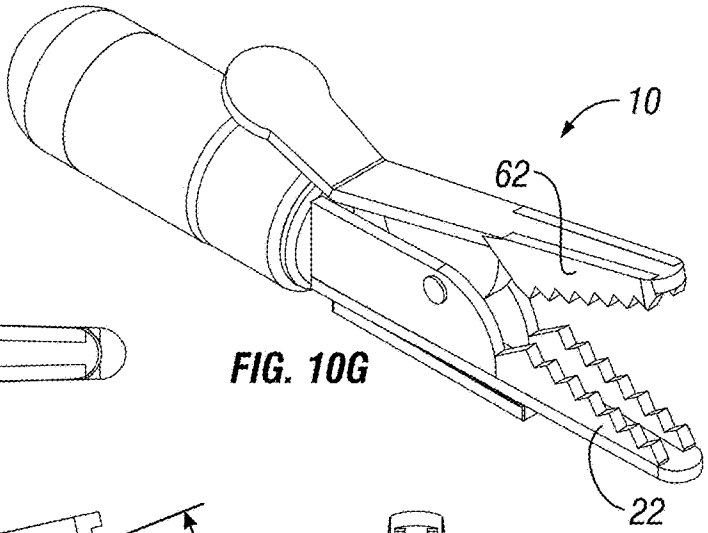
Figure 10L:
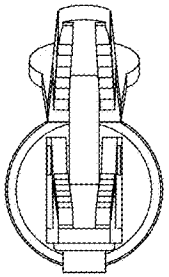

FIG. 10A is a perspective solid-body view similar to FIG. 9A but showing hinged jaws in open position compared to the normally closed position of FIG. 9A.

FIGS. 10B-F are isometric side elevation (the opposite side is a mirror image), bottom plan, top plan, one end elevation, and opposite end elevation solid-body views, respectively, of the apparatus of FIG. 9A.

FIGS. 10G-L are similar to FIGS. 10A-F but line drawings.

Figure 11A:
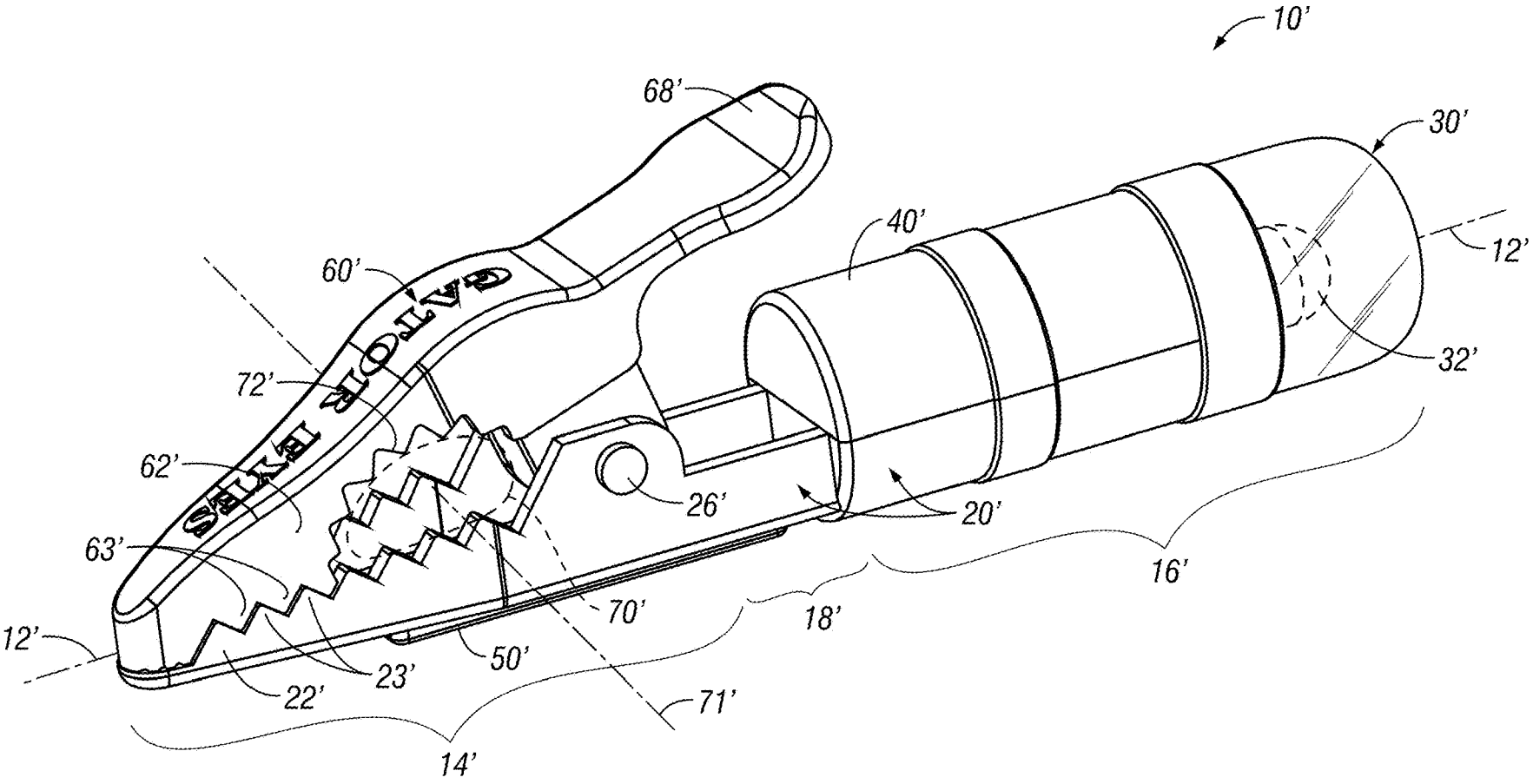

FIG. 11A is a perspective assembled view of an alternative embodiment according to the invention.

Figure 11B:
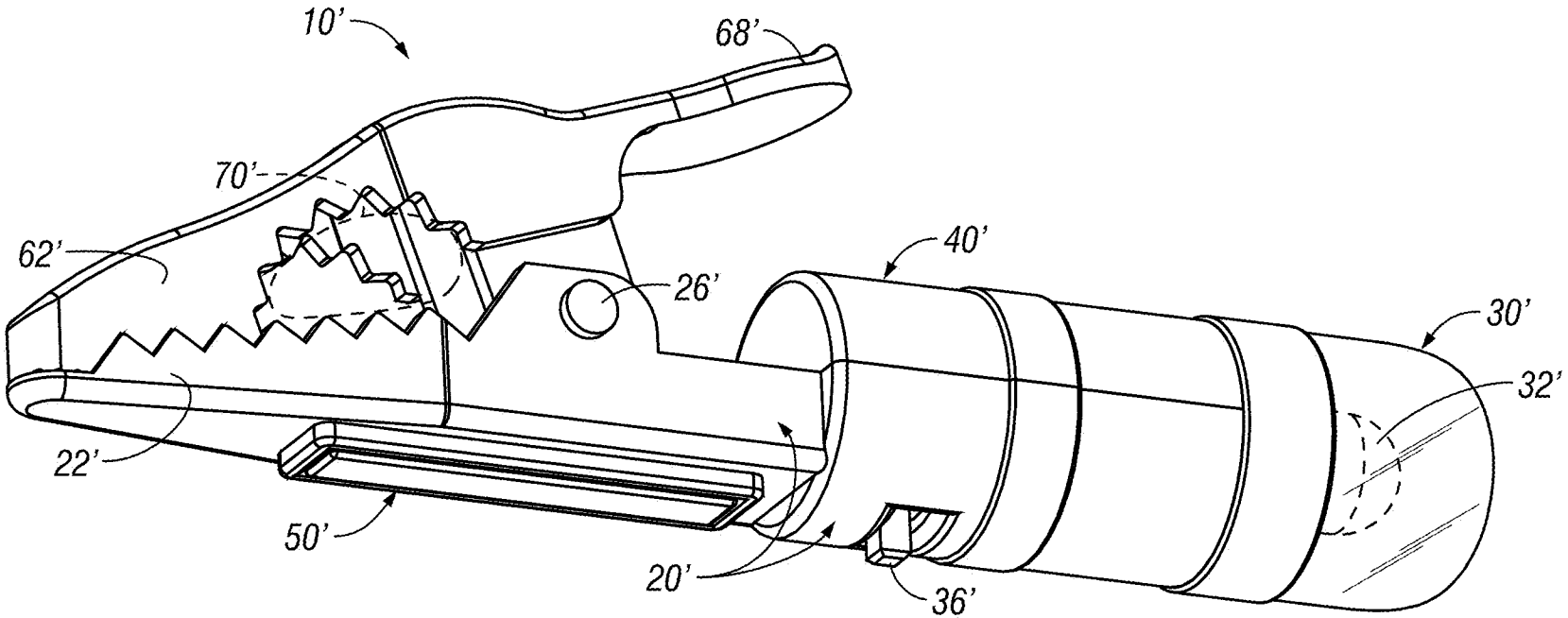

FIG. 11B is a perspective view of the embodiment of FIG. 11B from a different viewing direction.

Figure 11C:
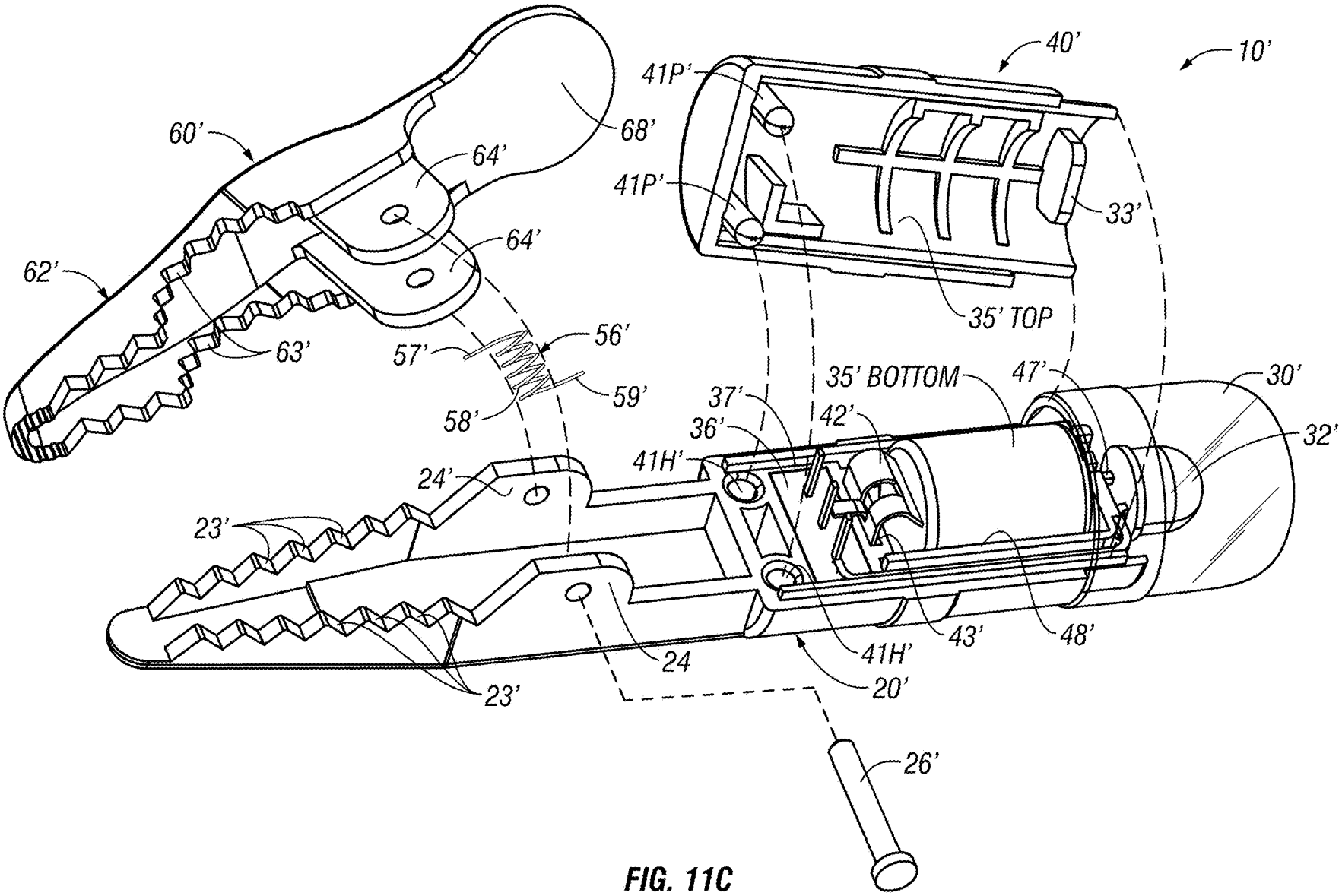

FIG. 11C is a partially exploded view of the embodiment of FIG. 11A, some of the components assembled and some exploded away.

Figure 11D:
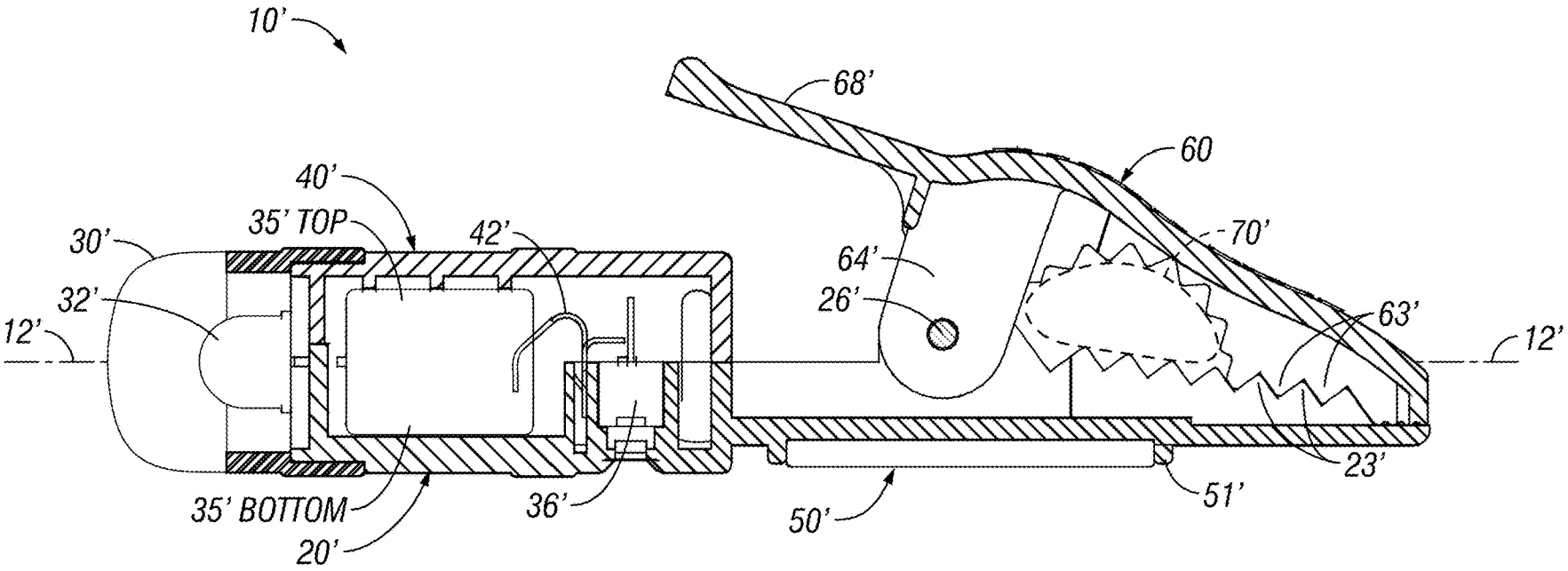

FIG. 11D is a sectional view of the embodiment of FIG. 11A.

Figure 12:
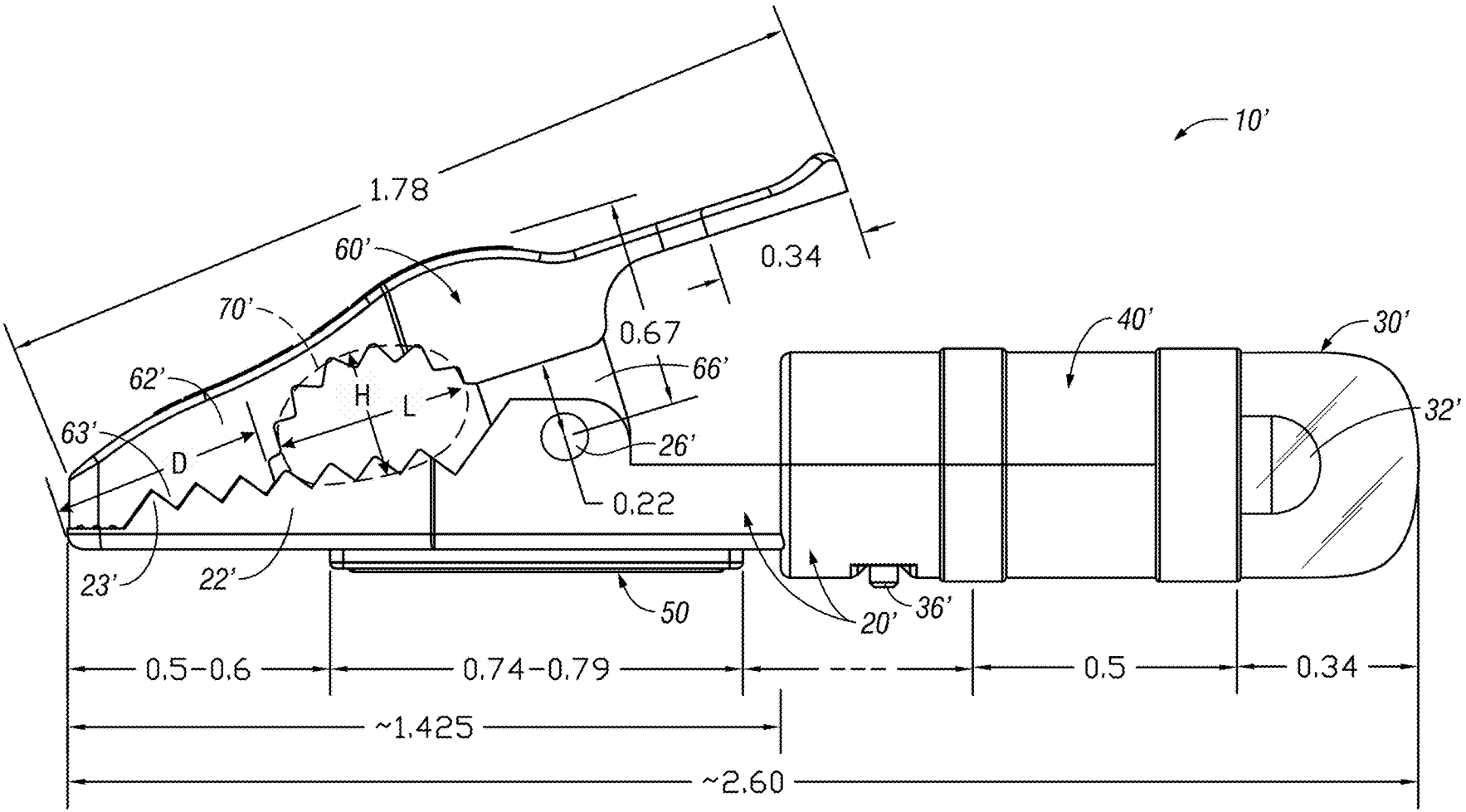

FIG. 12 is a side elevation of FIG. 11A.

Figure 13:
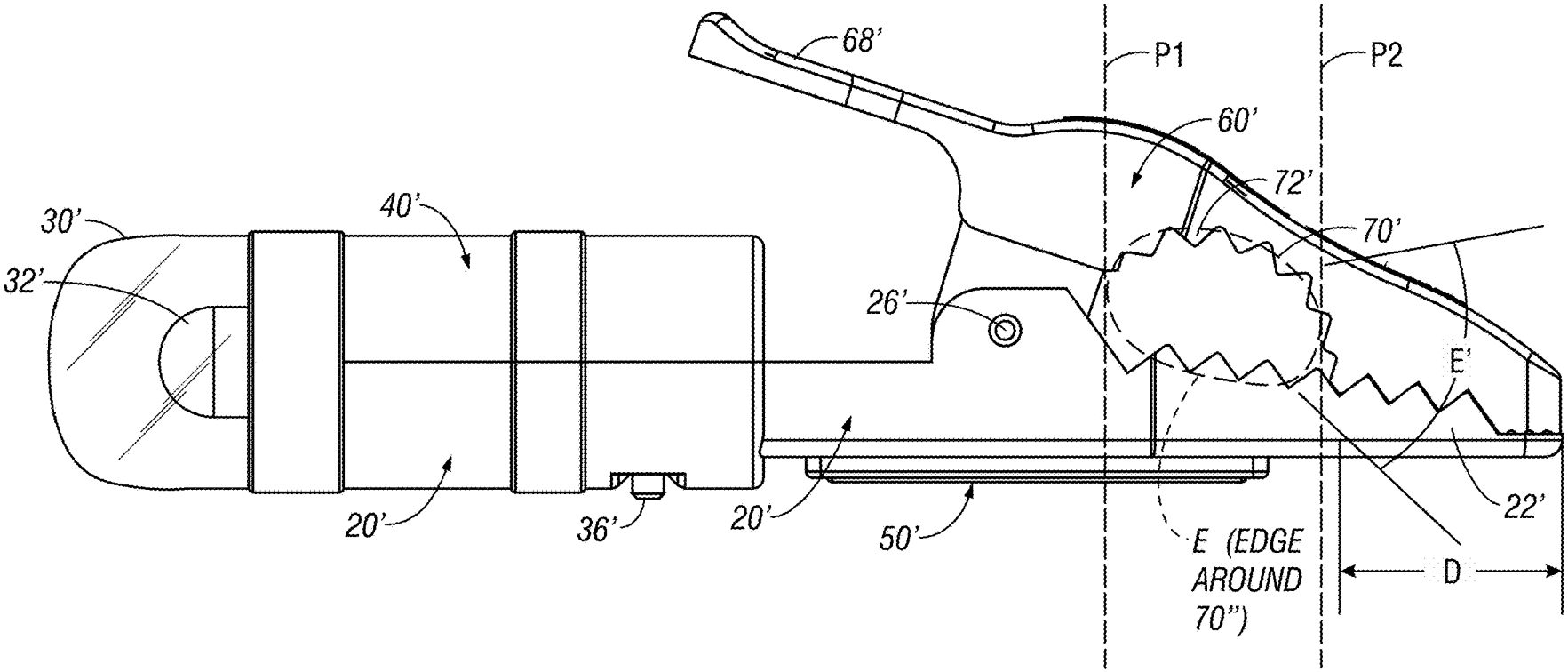

FIG. 13 is an opposite side elevation of FIG. 11A.

Figure 14:
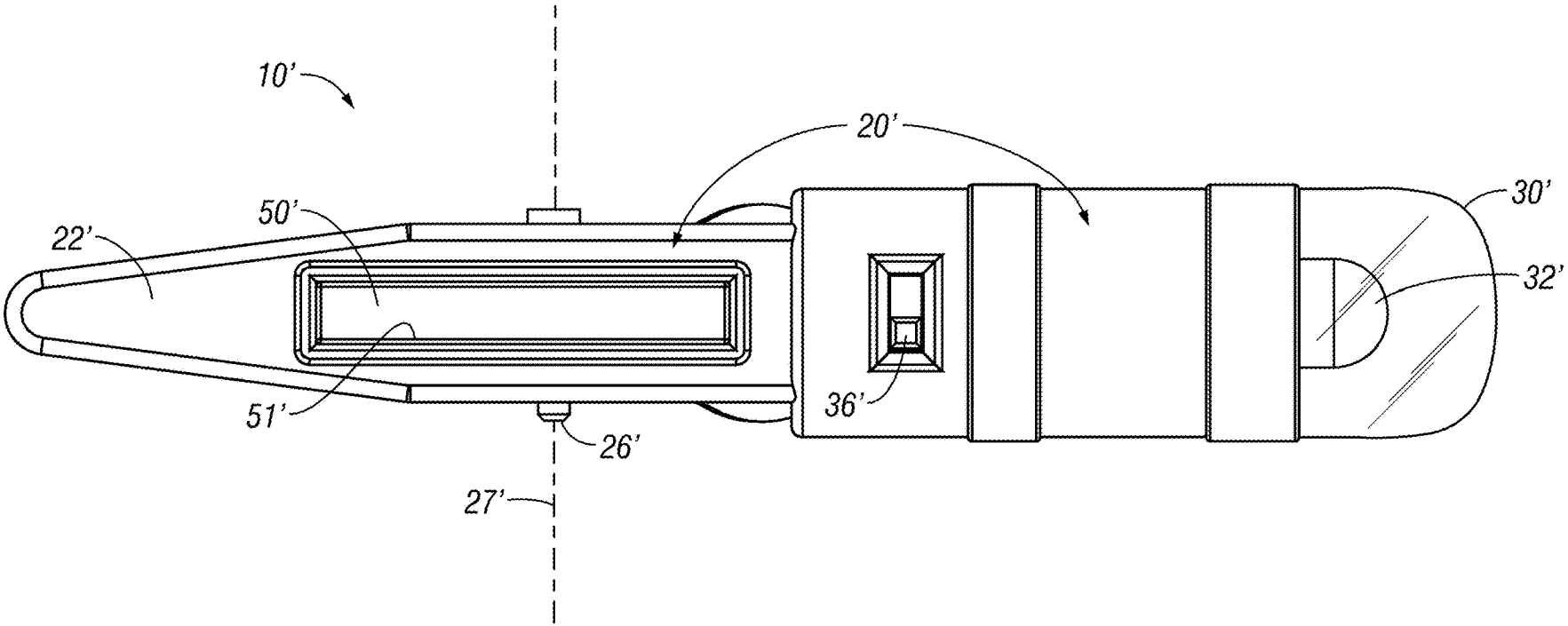

FIG. 14 is a bottom plan view of FIG. 11A.

Figure 15:
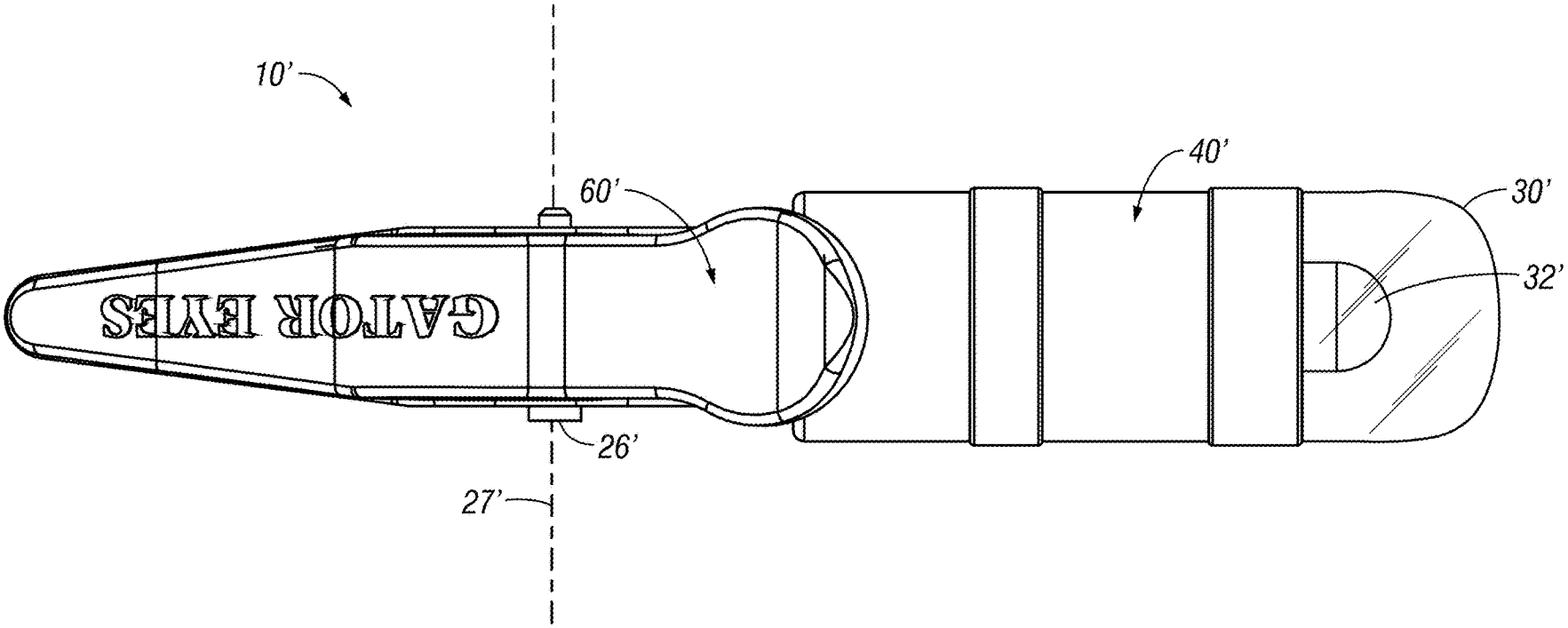

FIG. 15 is a top plan view of FIG. 11A.

Figure 16:
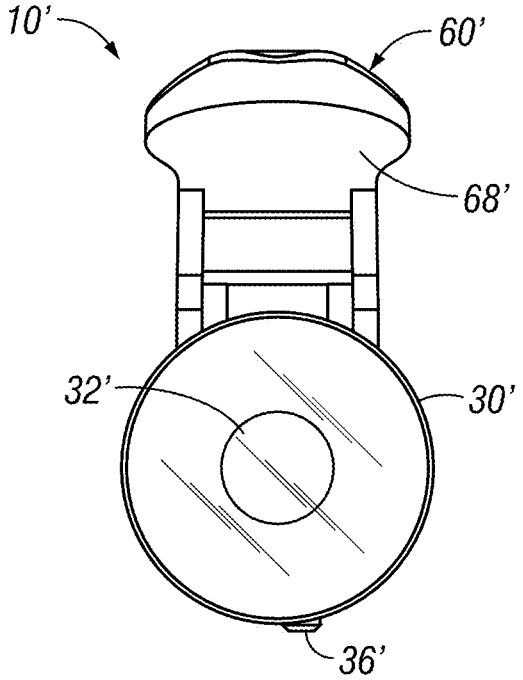

FIG. 16 is a right end elevation view of FIG. 11A.

Figure 17:
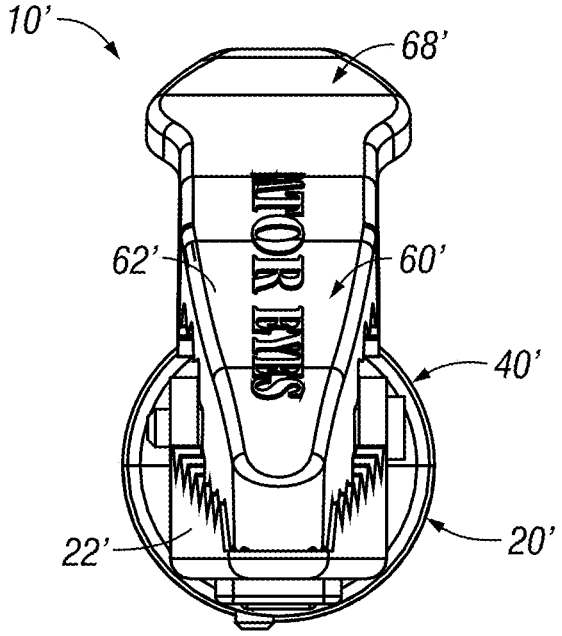

FIG. 17 is a left end elevation of FIG. 11A.

Figure 18A:
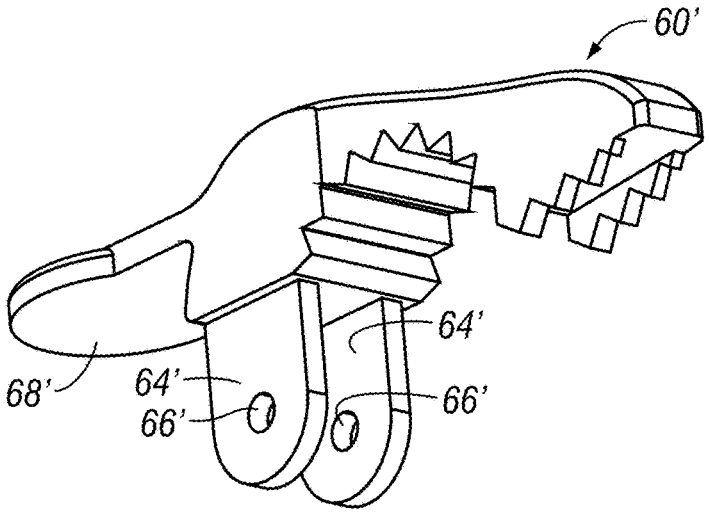

FIG. 18A is an isolated perspective view of the moveable jaw of the embodiment of FIG. 11A.

Figure 18B:
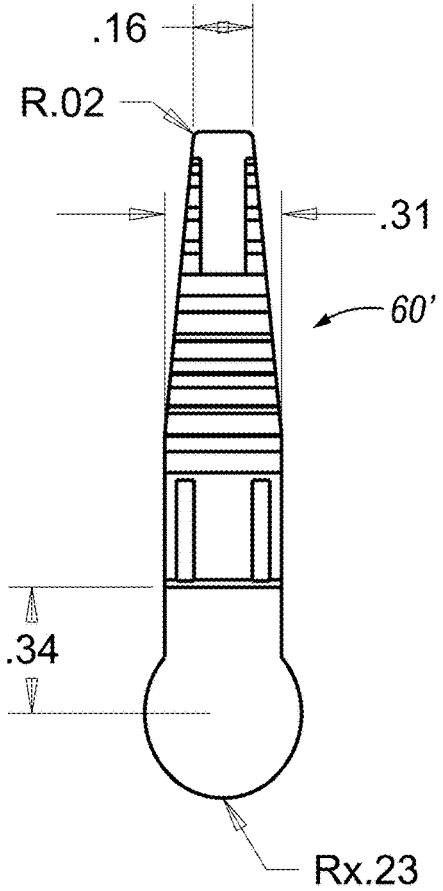
Figure 18C:
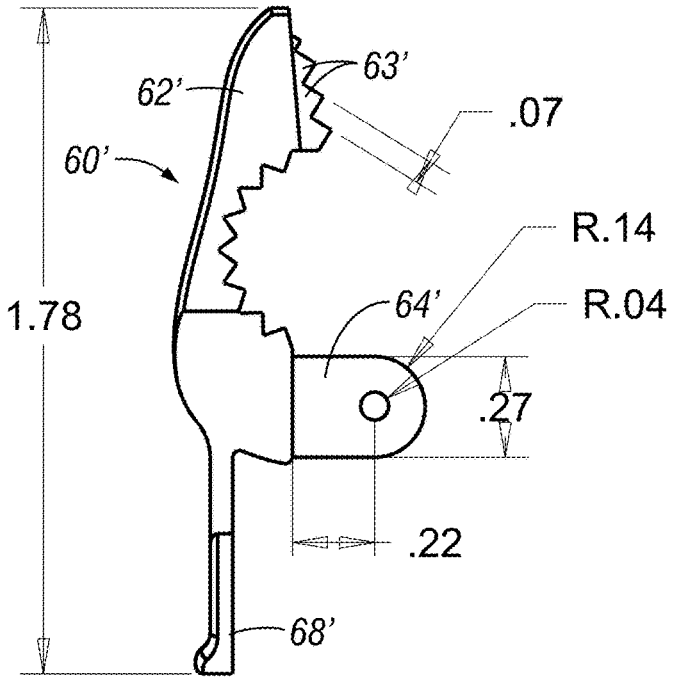
Figure 18D:
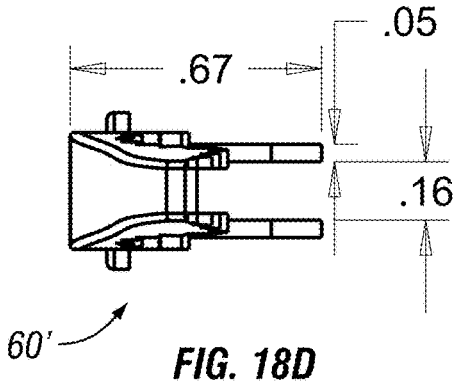

FIGS. 18B-D are isometric views of FIG. 18A from bottom plan, side elevation, and front end elevational respectively. Exemplary dimensions are in inches.

Figure 19A:
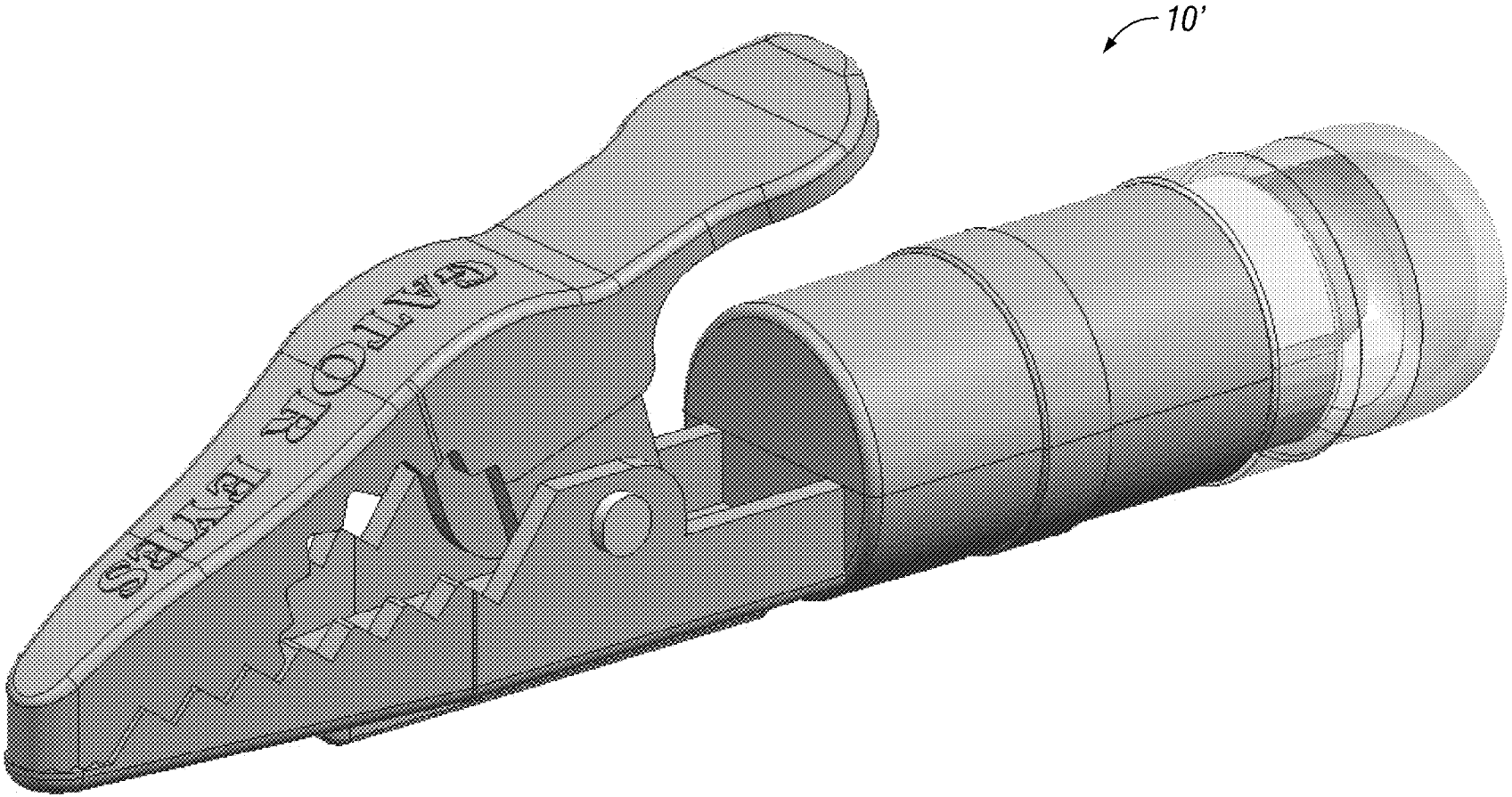

FIG. 19A is a perspective view of the embodiment of FIG. 11A from a still further viewing direction.

Figure 19B:
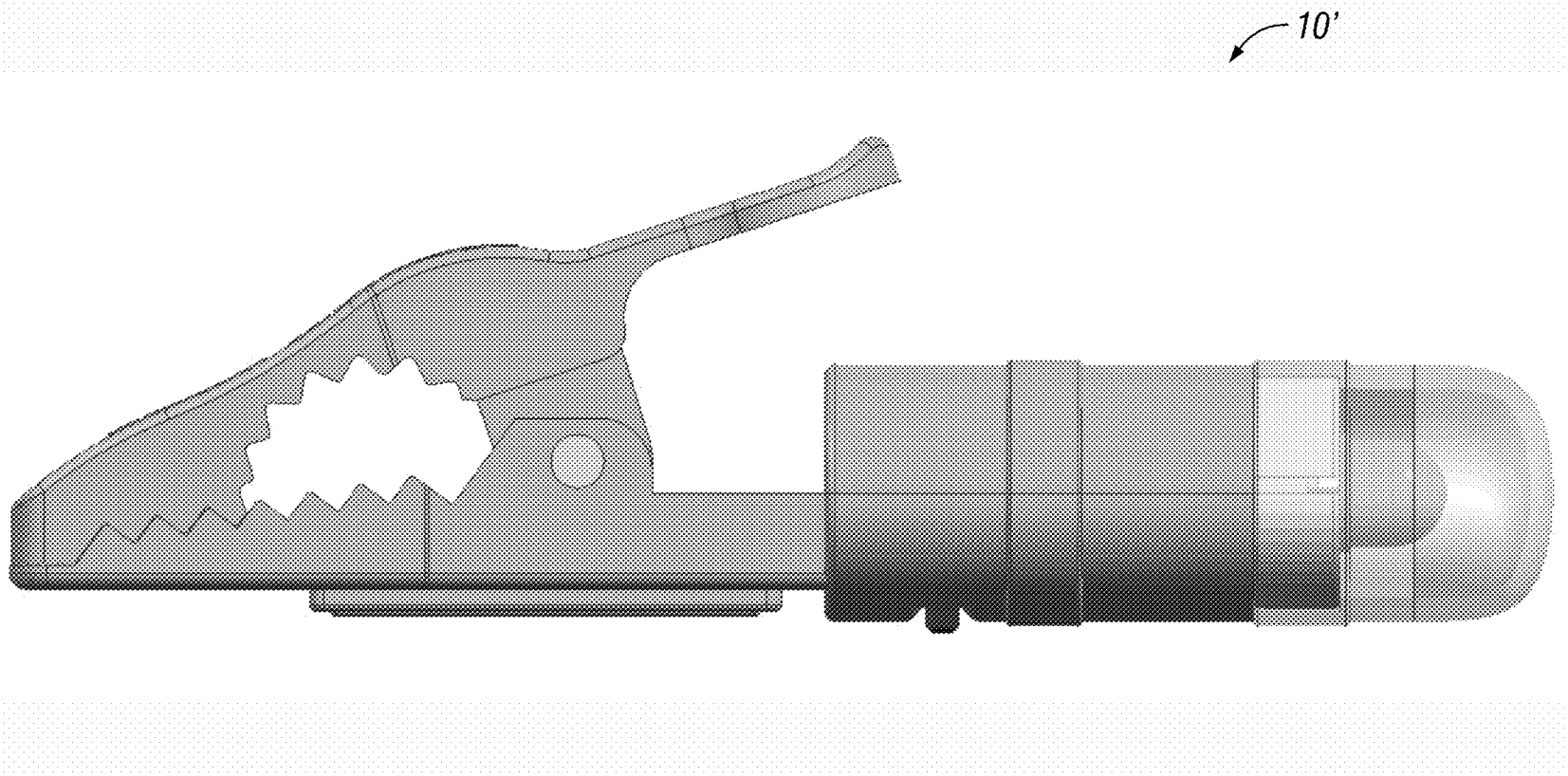
Figure 19C:
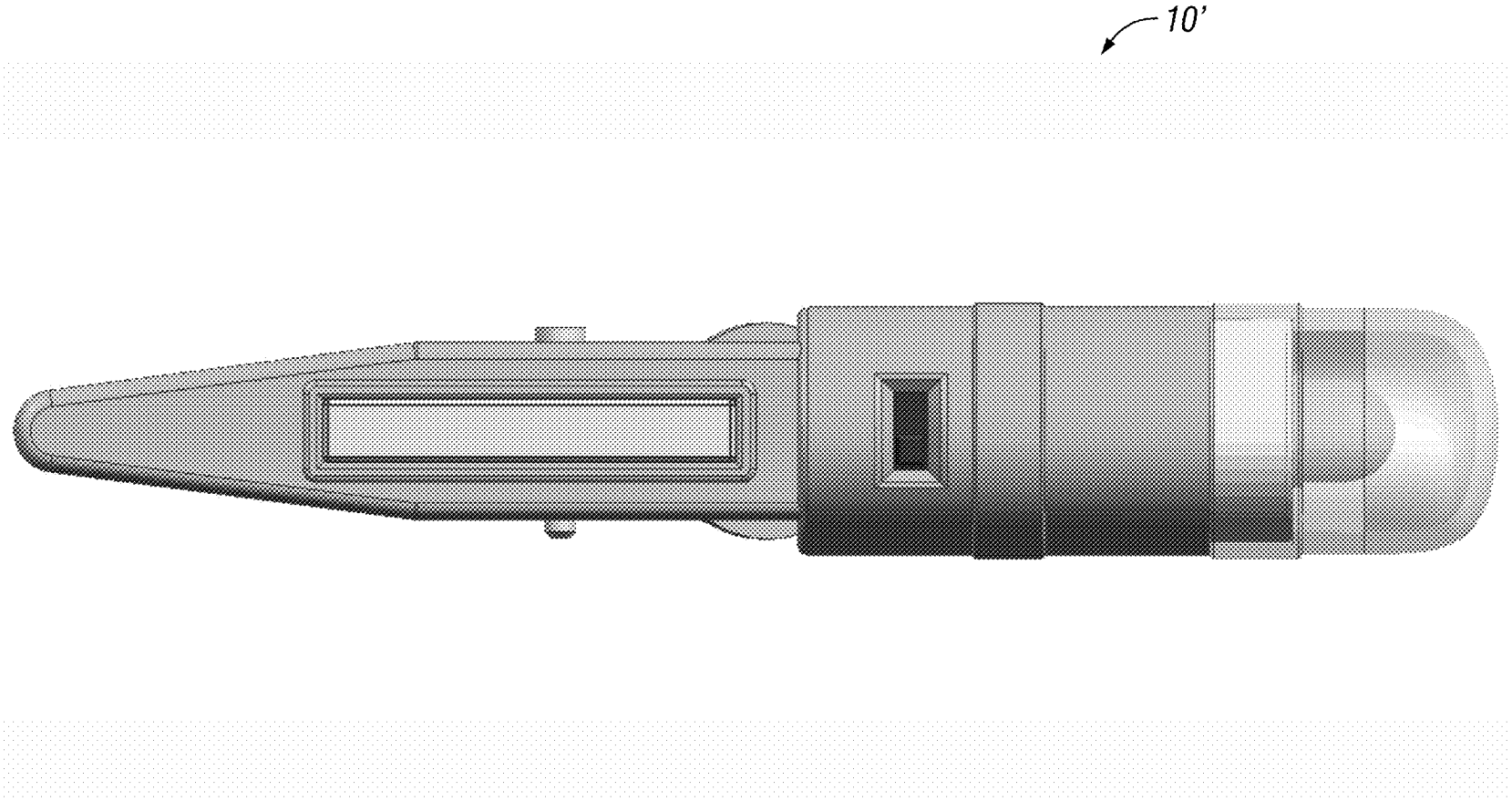
Figure 19D:
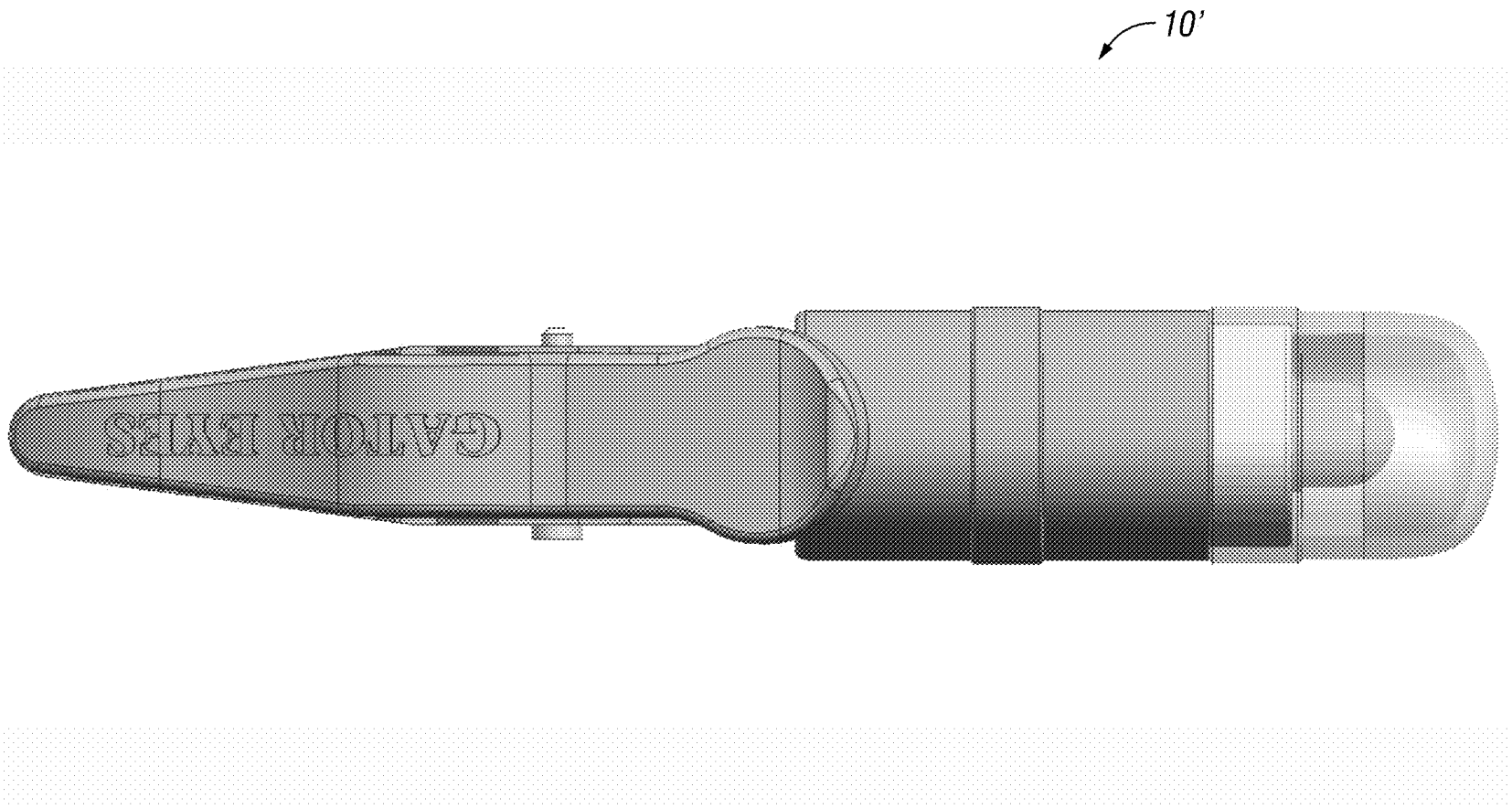

FIGS. 19B-D are isometric side elevation (the opposite side is a mirror image), bottom plan, top plan, one end elevation, and opposite end elevation, respectively, of the apparatus of FIG. 19A.

Figure 20:
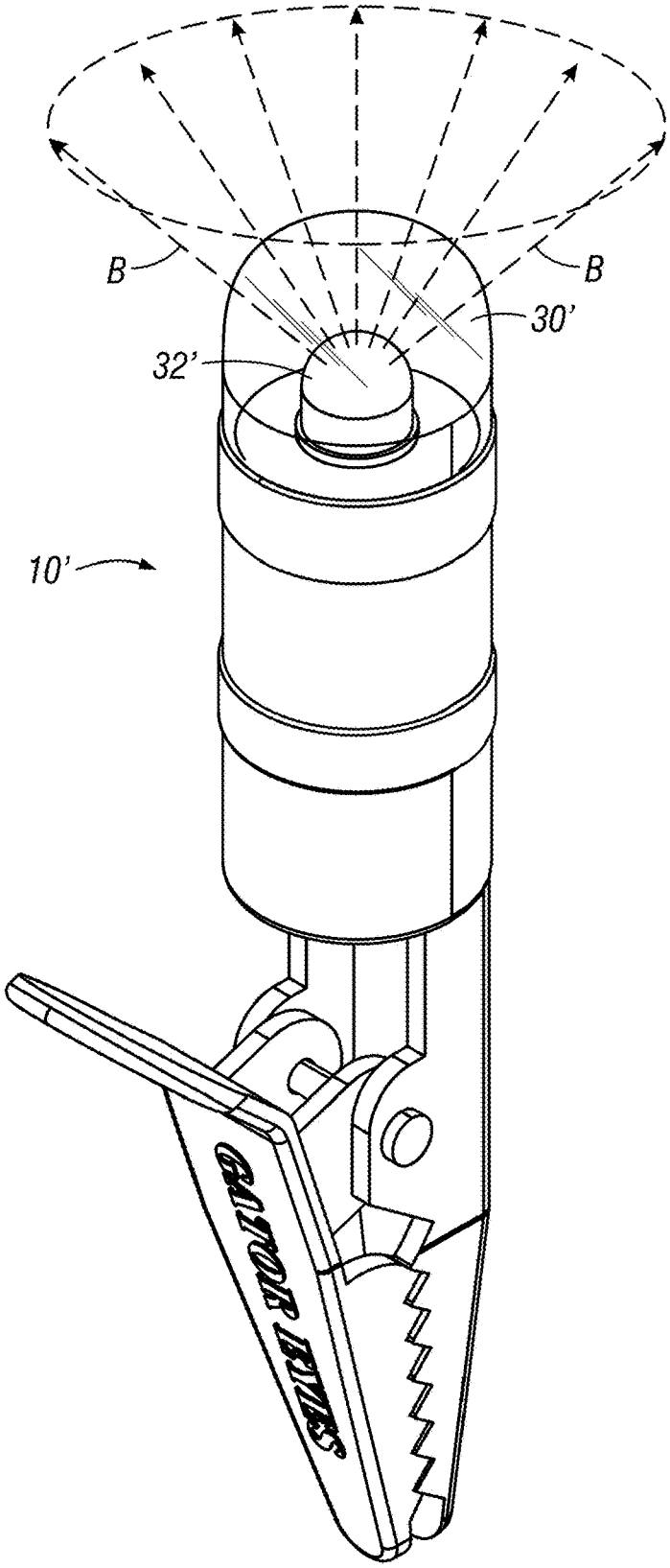

FIG. 20 is a diagrammatic view of the embodiment of FIG. 11A illustrating one possible beam distribution pattern from the light source.

Figure 21:
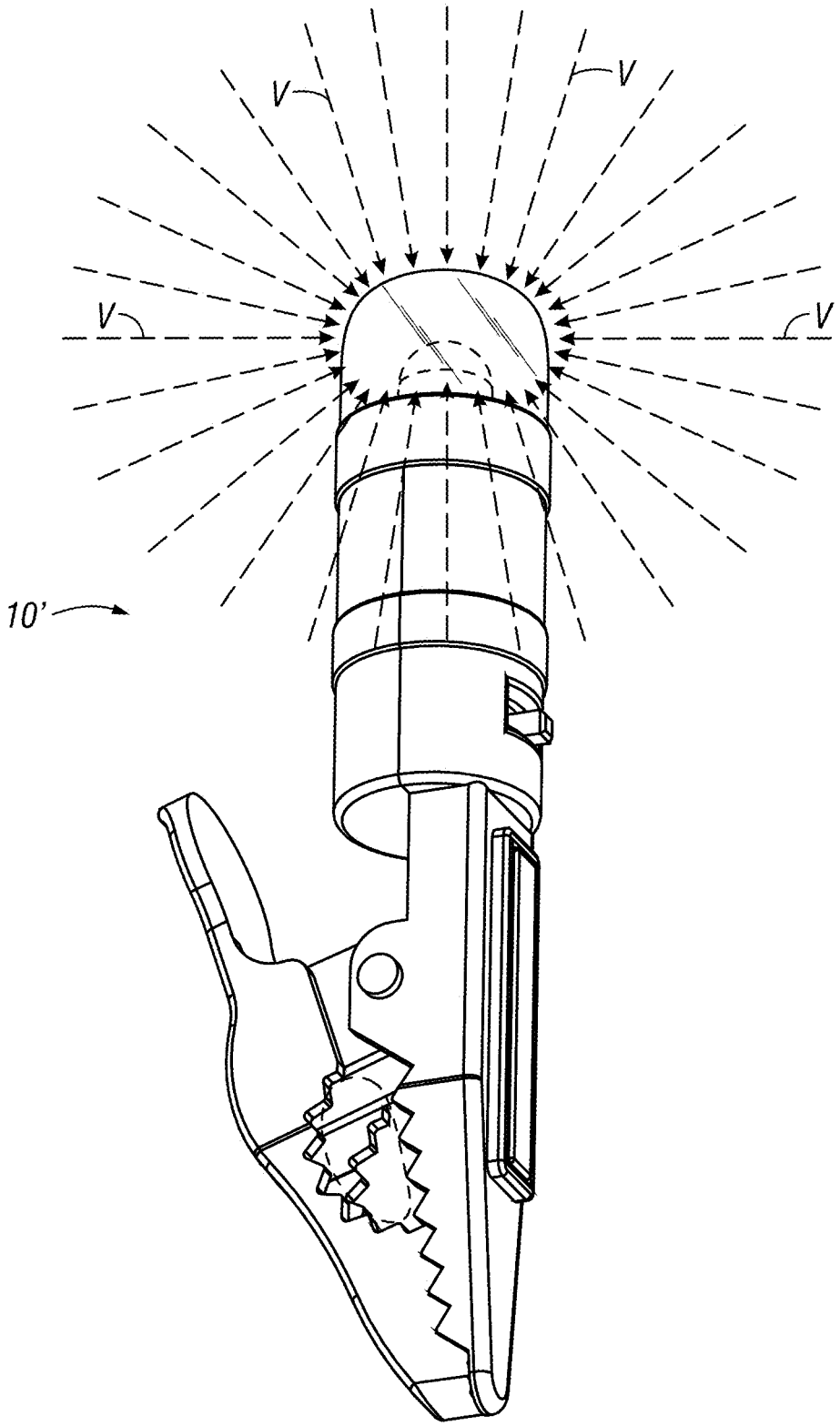

FIG. 21 is a diagrammatic view of the embodiment of FIG. 11A illustrating how the luminance of the light source and lens can be seen from a variety of viewing directions around the tool.

Figure 22:
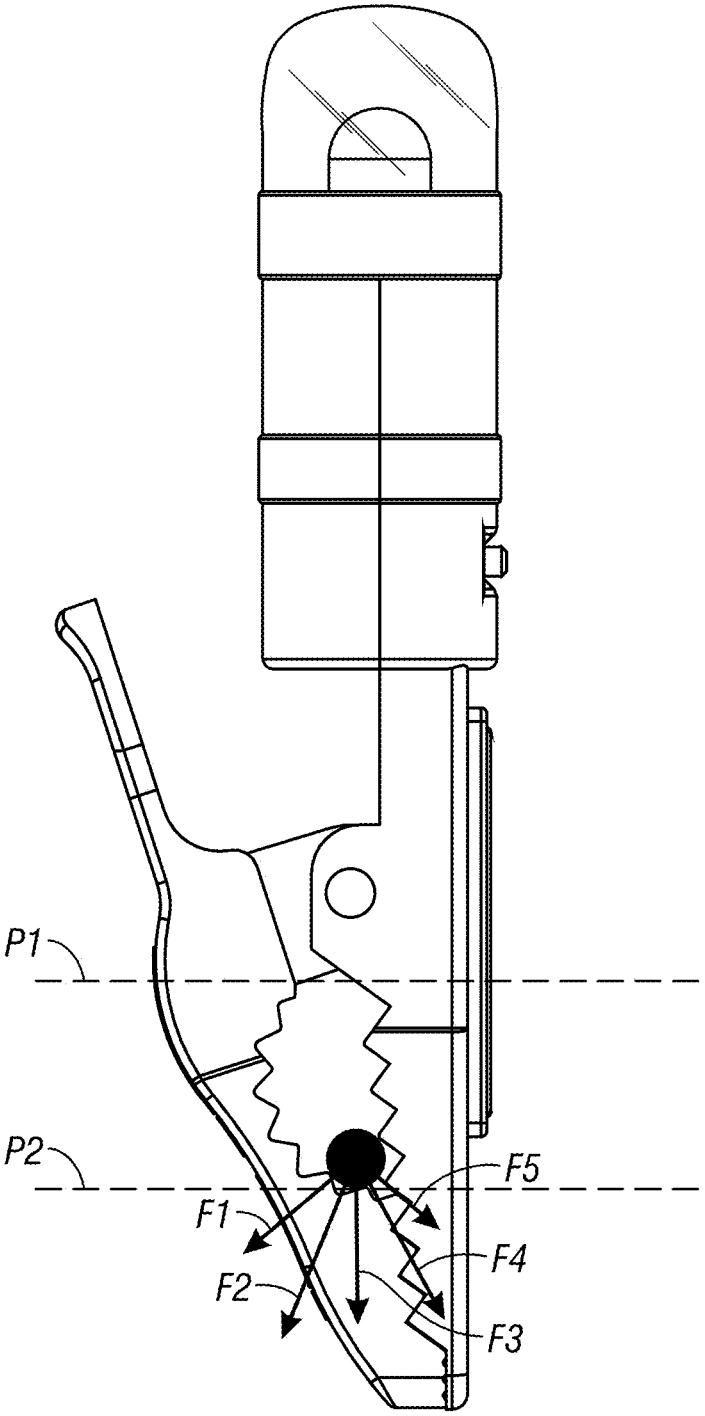

FIG. 22 is a diagrammatic view of the apparatus of FIG. 11A illustrating how the clamping jaws can be opened, a key ring or similar-in-cross-sectional-area object inserted past those jaws into the gap behind them, and the key ring or similar enclosed by the gap behind the normally-closed jaws of the clip portion of the apparatus and retained against removal. FIG. 22 is a side elevation showing the key ring in cross-section and diagrammatically illustrating how the clip and opening work together to resist the key ring from separating from that position or opening the normally closed jaws. FIG. 22 shows how even if the jaws do separate, in a variety of orientations, the key ring will not separate even if pulled in the directions F1, F2, F3, or F4.

Figure 23:
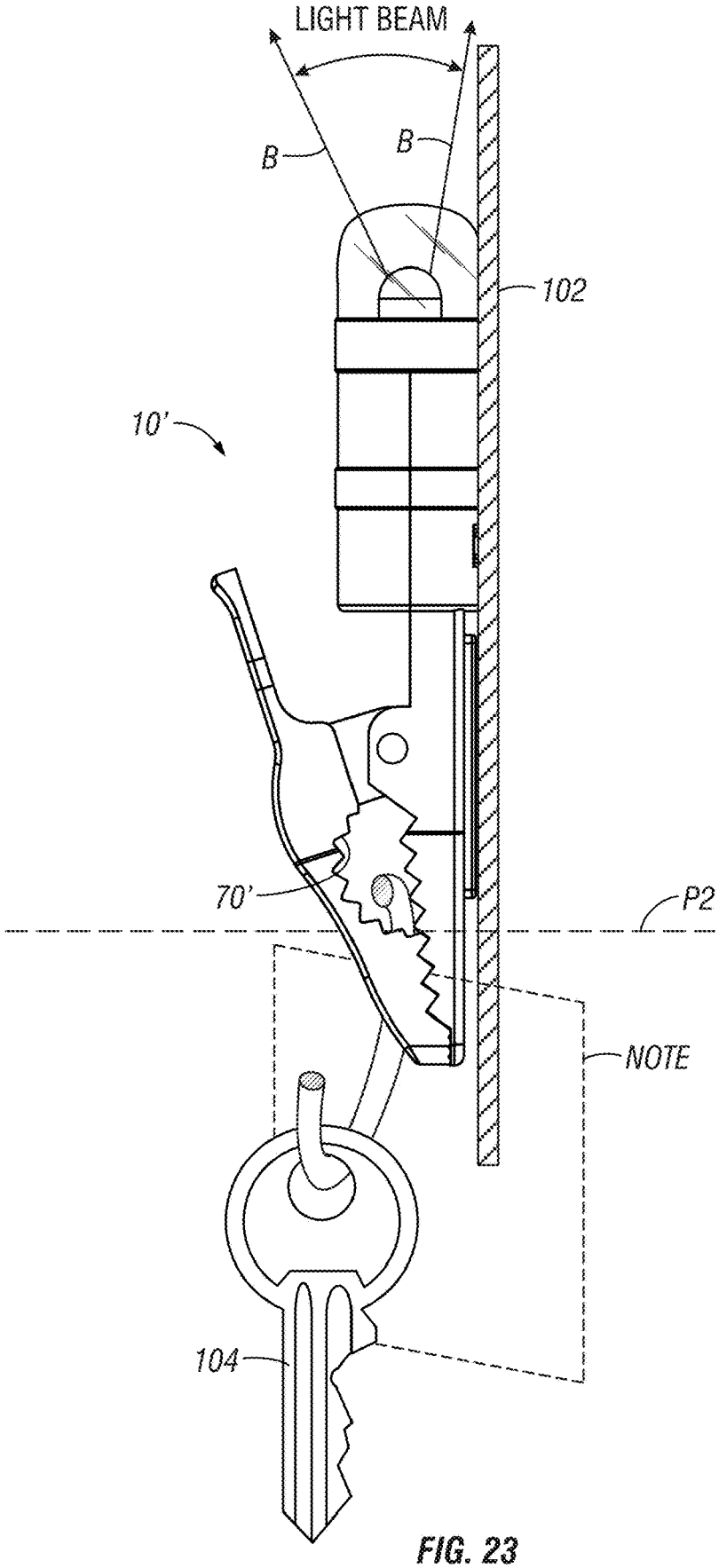

FIG. 23 shows the apparatus of FIG. 11A mounted to a metal surface with the on-board magnetic of the apparatus with a variety of other concurrent functions including holding a key ring, a note or picture and having the light on.

Figure 24A:
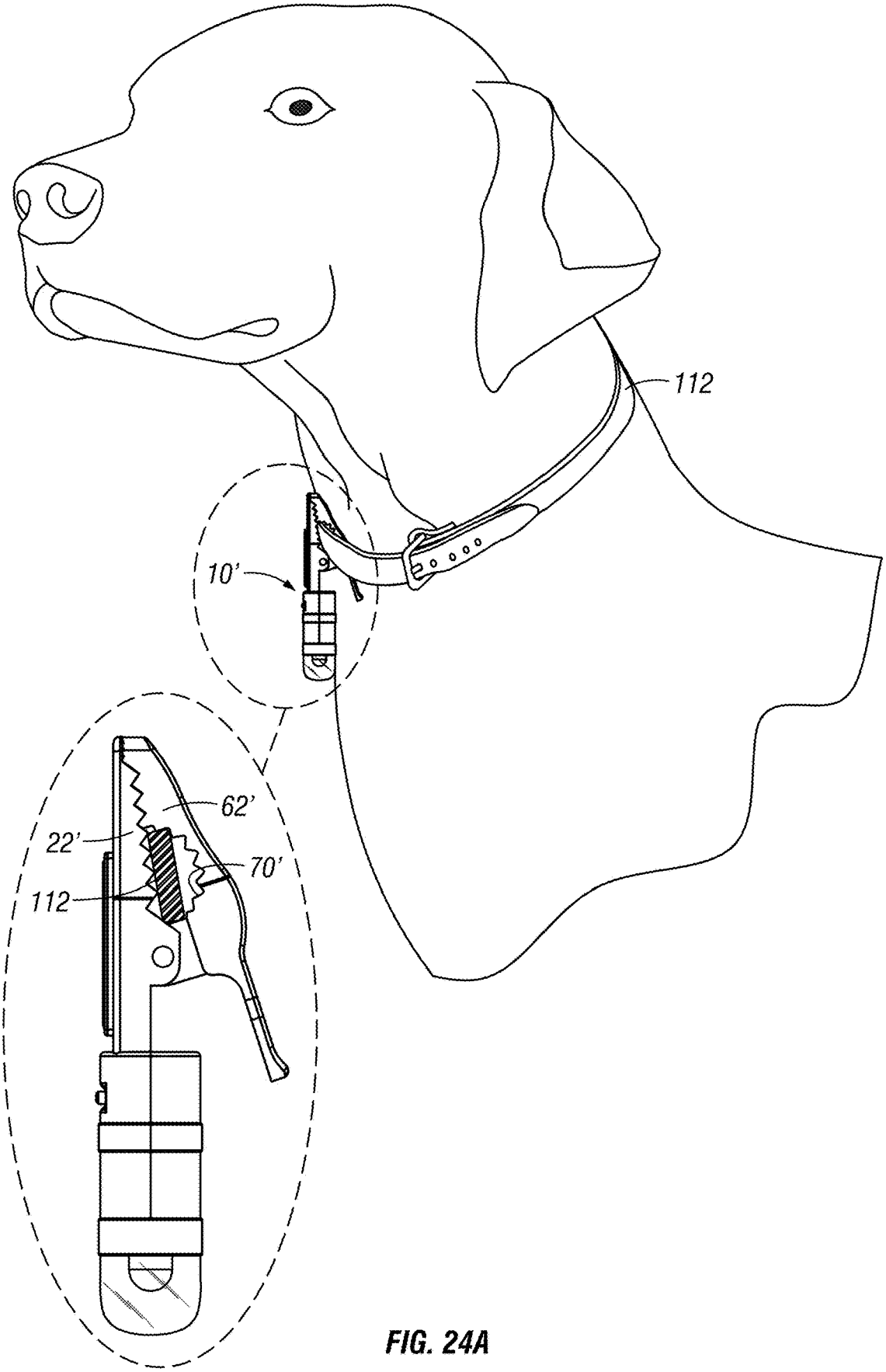
Figure 24B:
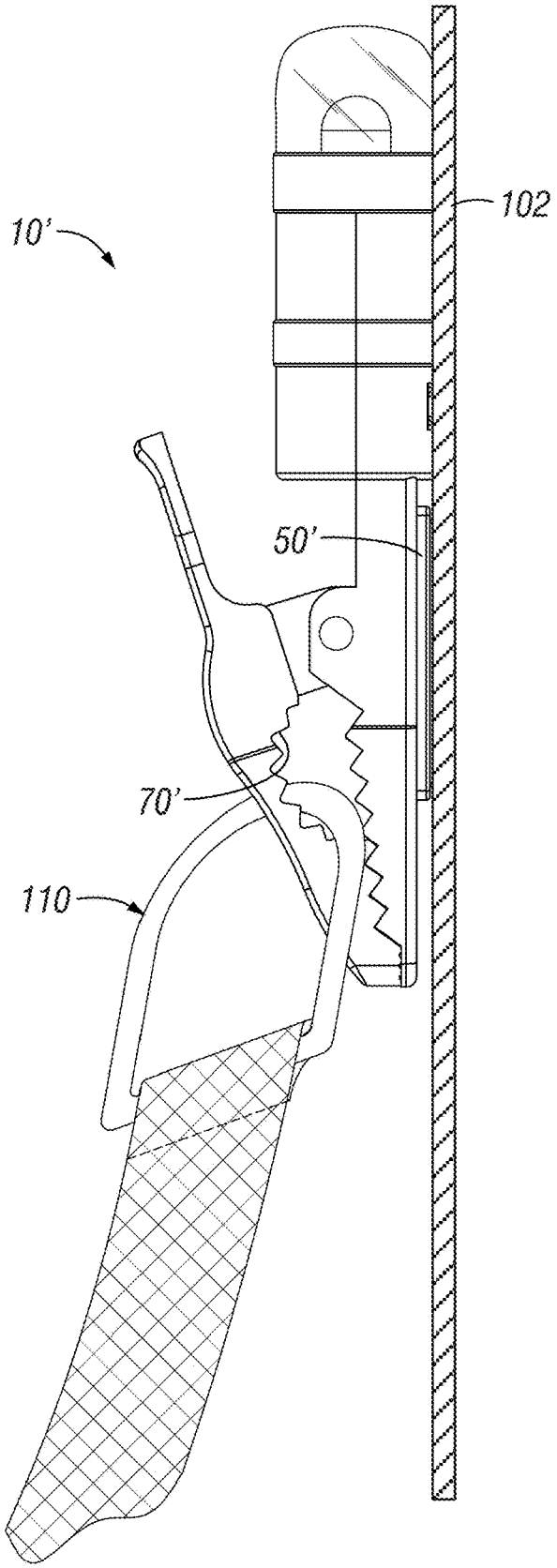
Figure 24C:
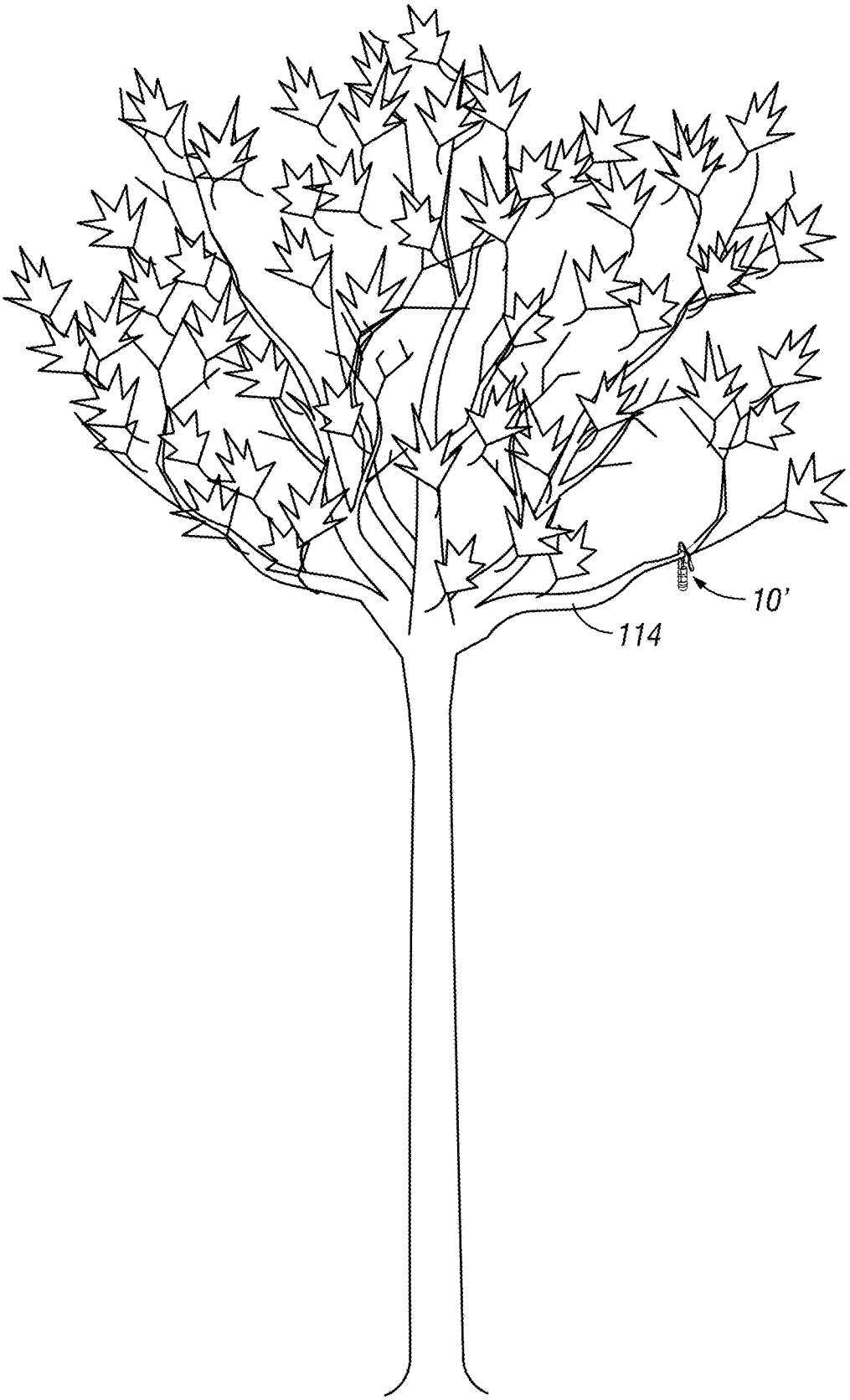

FIGS. 24A-C show how the apparatus of FIG. 11A can either be clipped or retained from another object with or without the jaws of the clamp holding another object and/or the light used. FIG. 24A shows the apparatus of FIG. 11A retained on a dog collar. FIG. 24B shows it retaining a D-ring. FIG. 24C shows it hung from a branch with the gap behind the normally-closed jaws of the clip portion of the apparatus with or without one or more concurrent functions.

Figure 25A:
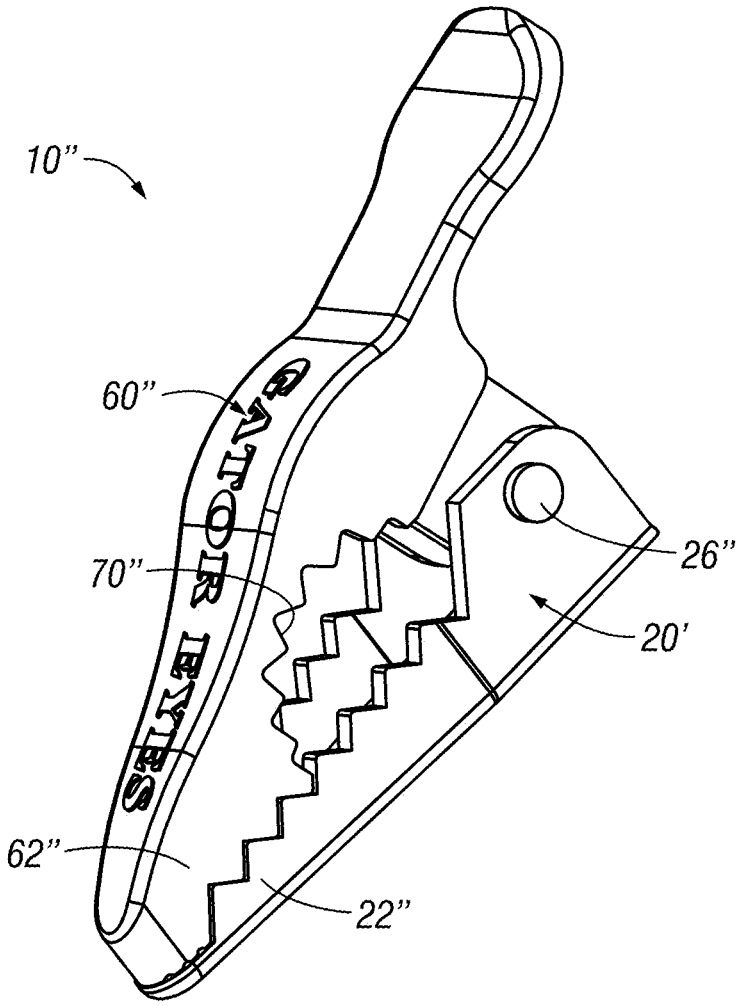

FIG. 25A is a perspective view of a still further embodiment of the invention according to aspects of the invention, here a tool with just the clamping and retaining functions of the embodiment of FIG. 11A.

Figure 25B:
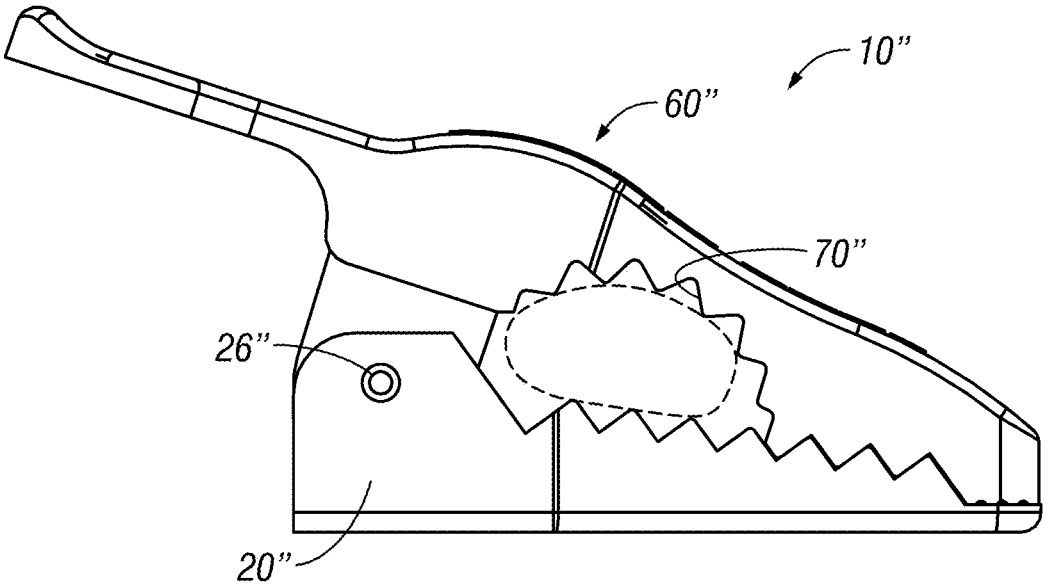

FIG. 25B is a side-elevation of FIG. 25A.

Figure 26:
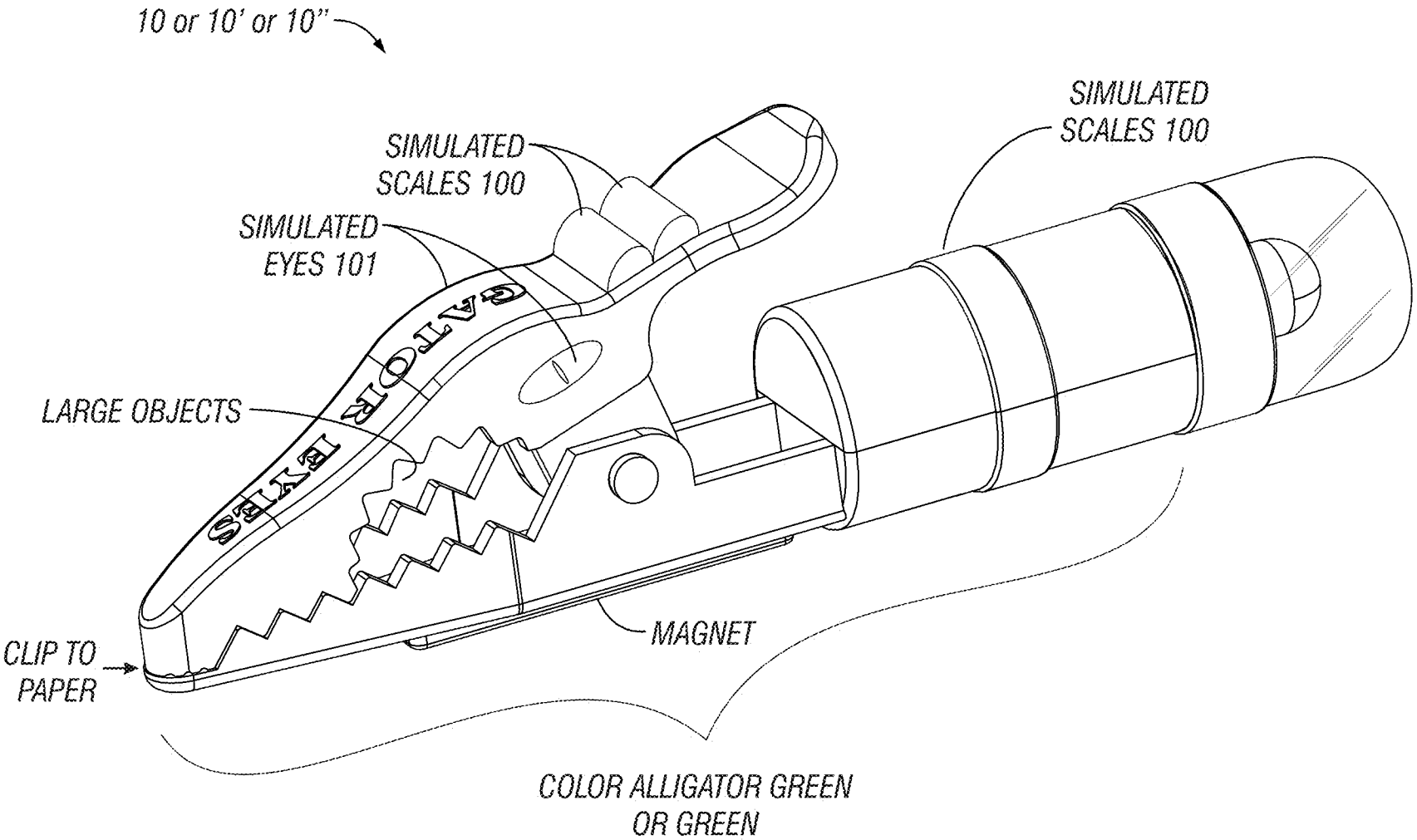

FIG. 26 is a highly diagrammatic view of an optional version of the assembly of FIG. 11A, in particular, with a simulated alligator appearance of toothed jaw, eyes, and spine bumps.

IV. DETAILED DESCRIPTION OF EXEMPLARY EMBODIMENTS

A. Overview

For a better understanding of the invention, some specific examples of embodiments invention can take will now be described in detail. It is to be understood that these are neither exclusive nor inclusive of all forms and embodiments the invention can take. Variations obvious to those skilled in this technical area included within the invention.

B. Embodiment 1

1. Apparatus

With specific reference to FIGS. 1A-H to FIGS. 2-10L, a first embodiment of a mini-light assembly 10 includes an integrated combination with multiple potential purposes and functions. Assembly 10 has a general longitudinal axis 12. It is to be understood that this is but one embodiment according to the invention. It has multiple functions and uses. Other embodiments can include a subset of those functions in different combination.

A first end 16 of assembly or tool 10 includes a cylindrical housing portion associated with an LED light source 32 and circuit to operate it to provide a mini-light functionality for such things as task and fiducial marking.

A second end 14 of assembly 10 includes both a clamp or clip, a retaining gap behind the clip, and a magnetic mount 50 all to provide a variety of mounting/retaining functions.

A transition section 18 links and supports ends 14 and 16.

In this embodiment, the body of tool 10 is made from the following principal plastic molded pieces.

Base 20. What will be called base 20 is one piece and a base/fixed jaw 22 of end 14 integral with what will be called the bottom or ventral half of a housing 28 for end 16.

Lens 30. A light transmissive lens 30 is both a lens/cover for LED 32 as well as cap to hold the pieces of the housing together.

Battery cover 40. A separate top or dorsal piece 40 mates with ventral housing half 28 to enclose a battery 34, an on-off switch 36, and the associated circuit 38 to operate LED 32. Magnet 50. An oversized permanent magnet 50 is fixed to the ventral side of base jaw 22 and has an exposed side for mounting to metal surfaces. The magnet could be positioned on the ventral side of housing half 28 of base 20 or a more intermediate position (more aligned with transition section 18 than side 14 or side 16).

Moveable Jaw 60. A separate pivotable moveable jaw 60 is pivotally connected to base 20 and has a clamping jaw portion 62 that is continuously resiliently biased towards abutment with fixed based jaw 22 by a biasing member. In this embodiment, the biasing member is a torsion spring 56 (see FIG. 1C).

Gap 70. An open area or gap 70 is intentionally included between jaws 22/62 and the pivot axis 27 for opening and closing jaws 22 and 62. Opening 70 is defined by interior edges and surfaces of jaws 22 and 62 behind where jaws 22 and 62 abut when in closed position, as well as portions of jaws 22 and 62 at and around pivot axis 26. Gap 70 is basically a 3D volume transverse to longitudinal axis 12 with open area on both sides along axis 71 of gap 70 transverse to axis 12 (see FIG. 1A). As explained herein, the cross-section area through gap 70 is intentionally large enough to enclose without clamping a variety of objects. One non-limiting example is a typical key ring. The cross-section area of the key ring is smaller than the cross-sectional area of gap 70. When jaws 22 and 62 are in closed opposition (in abutment), key ring can move around in gap 70 but is retained against movement out of gap 70 because the edges and surfaces defining gap 70 present mechanical stops in basically 360 degrees in a plane along axis 12 that includes jaws 22 and 62. Even though opening jaws 22 and 62 opens up access to the location of gap 70, because jaws 22 and 62 are constantly urged closed, there is a mechanical stop of at least some degree even when the object or the tool is pulled or forced against the portion of gap 70 at the interface between jaws 22 and 62. But substantial force would be needed to overcome the force biasing jaws 22 and 62 closed. And, if the retained object is pulled or forced against any other portion of gap 70, it either abuts a continuous portion of single piece jaw 22 or jaw 62, or the pinned pivotal junction of jaws 22 and 62 at and near pivot axis/pivot pin 27/26. The only way to overcome the mechanical stops at those portions is force sufficient to break the piece(s) or the pivot connection. Therefore, the combination of size of gap 70, selection of spring force of spring 56, and the materials for pivot pin 26 and base 20 and moveable jaw 60 can present consideration retaining function.

Light 32. As can be seen in FIGS. 1D and E, LED die 32 could be connected through switch circuit 38 to an internal battery 34, all positioned in the cylindrical portion formed by portion 28 of base piece 20 and battery cover piece 40. As shown in FIG. 1C, the housing is two pieces; a first half 28 and second half 40 that can be molded such that when assembled they form a hollow cylindrical portion. They can be snapped or otherwise fitted together with the somewhat hemispherical halves 28/40 forming an enclosure. Other configurations are a possible. The battery 34 and LED die 32 can be a single unit that is placed in-between the halves 28/40 and held in place when the halves are snapped together. Switch 36 can be interference-fit or otherwise positioned in a rectangular opening in a sidewall the cylindrical housing formed by 28 and 40, when assembled, for access. Alternatively, as indicated in FIG. 1C, LED die 32 can be mounted on a shelf 33 in one or both of the open ends of housing half 28 and/or battery cover 40 and circuitry wiring connect it to internal battery 34 and switch 36. See FIG. 1D for a simplified circuit diagram. Alternatively, as shown in the Figures, LED 32 can mount to a shelf 33 at the lens end of battery cover 40 and/or housing half 28, battery 34 fit into molded bay 35, and switch 36 into molded bay 37. An electrically-conducting clip 42 (e.g. metal) could have one end 45 seated in molded slot 43 in housing half 28, extend into the battery bay 35 and be electrically connected to switch 36 by wire 46 (see FIGS. 1D and E). End 44 of clip 42 would provide spring-biasing against one end of battery 34 to promote retention of battery 34 in bay 35 and good consistent electrical contact with that end of battery 34 and would be conductively connected through the metal body of clip 42 to one terminal of switch 36. The other end of battery 34 would be urged against another conductor and wiring 47, in turn connected to one terminal of LED 32. Wiring 48 would connect the other terminal of switch 36 to the other terminal of LED 32 for a complete circuit to operate LED 32 when switch 36 is closed/conducting.

By manufacturing techniques, the combination of this circuit and LED assembled into two-piece body 28/40 can essentially be substantially sealed and resist penetration of moisture. It is possible that such things as O-rings, glues, or sealants could also be used towards that end. All components could therefore be substantially sealed at or within the interior of the housing 28/40. See, e.g., FIG. 8 for one non-limiting example.

Thus, as described above, end 16 of assembled tool 10 is a light source. The opposite end 14 of assembly 10 is a multi-featured mount combination. A clamp or clip includes base jaw 22, here integrally molded to bottom piece 20. Base jaw 22 includes a receiver 51 (see FIG. 1C) on its outward-facing side for complementary fit of magnet 50, which could be interference fit or otherwise fixed such as by adhesives or other techniques in place with its outer surface at least flush with the receiver. The opposite side of base jaw 22 could have both smoother portions and toothed or serrated portions that, when assembled with moveable jaw 60, form facing similar portions that can both grab thinner, more planar objects (e.g. clothing, paper, cardboard) with the teeth. But, as shown and described, gap 70 interiorly of those clamping portions of jaws 22 and 62 provides structure that surround and capture objects that have cross-sectional areas or largest dimensions that fit within the area or dimensions of gap 70 between open sides. This can include a variety of objects. Non-limiting examples include rings or loops (e.g. key rings, D-rings, cloth bag handles) or more elongated, rod-like objects (e.g. branches, rods, ropes) at a location behind the teeth for dual types of mounting/retainment.

Figure 3:
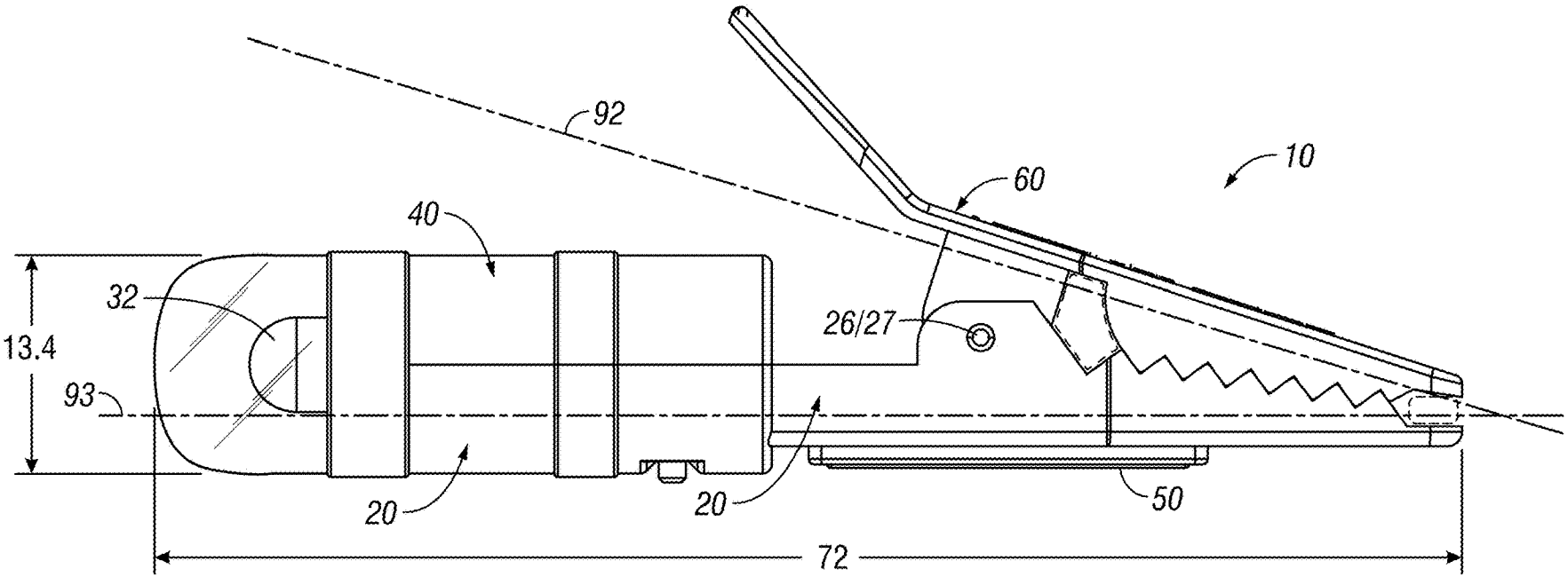
FIG. 3 is an enlarged opposite side view of FIG. 1A. Exemplary dimensions are in millimeters.
Figure 4:
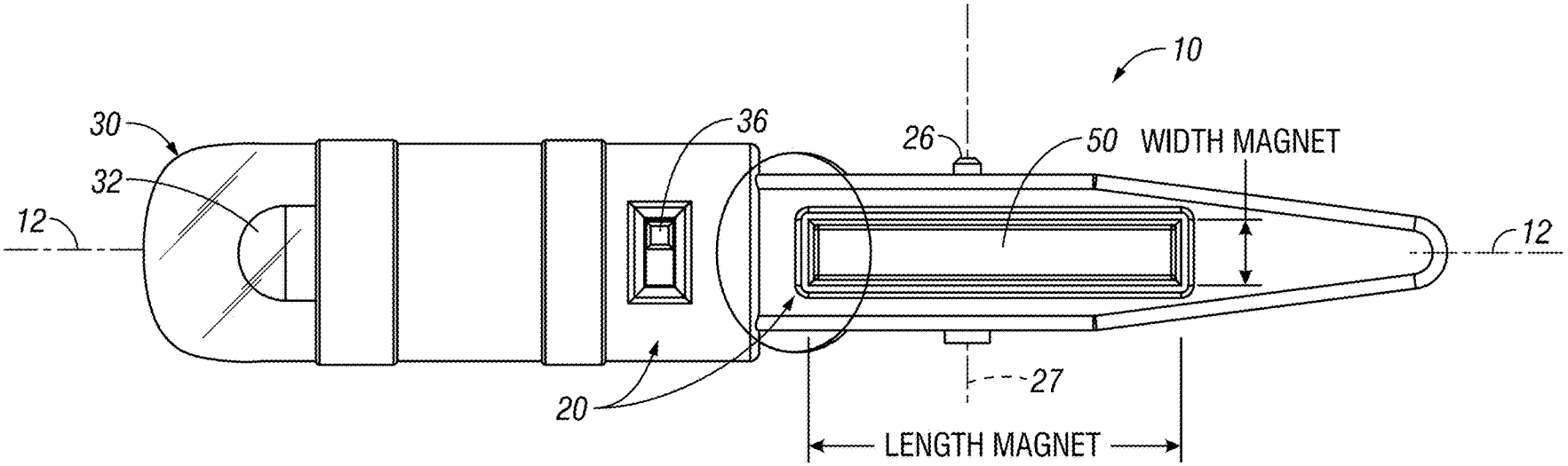
FIG. 4 is an enlarged bottom plan view of FIG. 1A.
Figure 5:
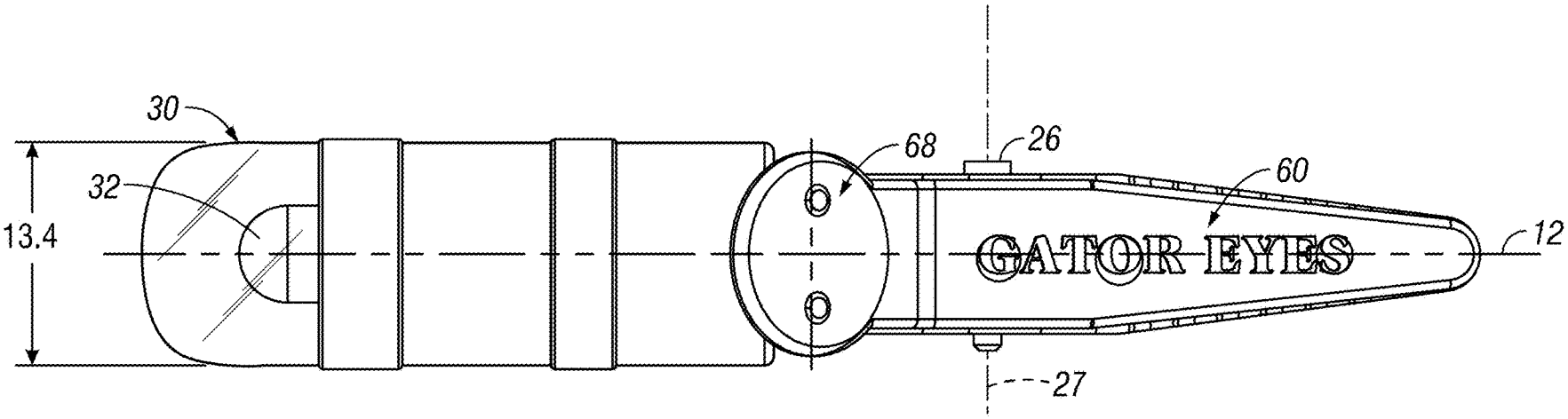
FIG. 5 is an enlarged top plan view of FIG. 1C.
Figure 6:
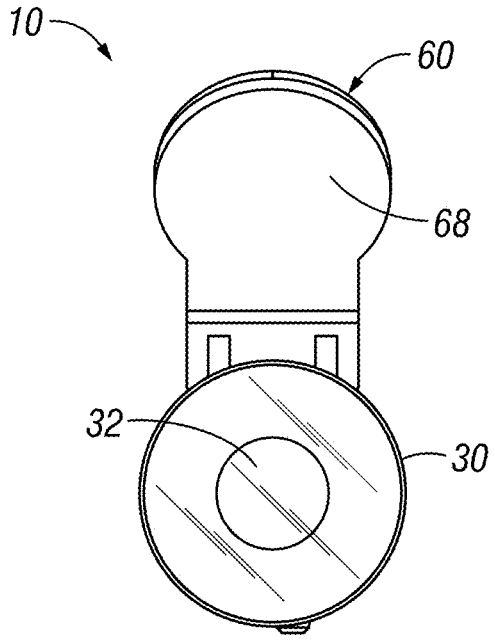
FIG. 6 is an enlarged end view of one end (the light end) of FIG. 1C.
Figure 7:
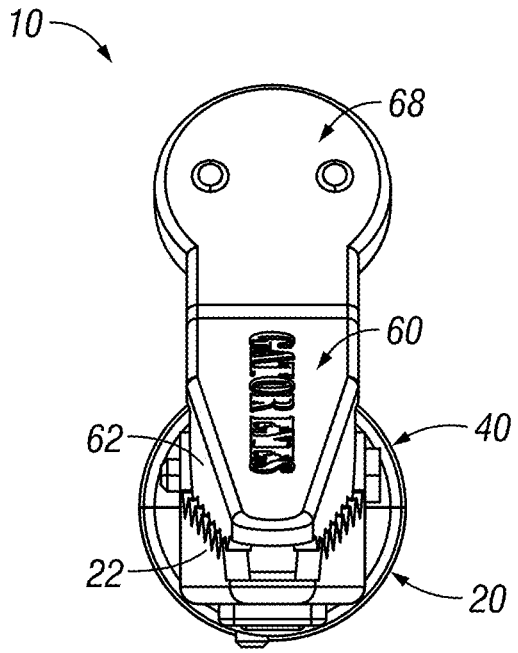
FIG. 7 is an enlarged opposite end view (the clamp and retaining end) of FIG. 1C.

Jaws 22 and 62 pivot around axis 27 at a metal pin 26 through aligned apertures 26/66 in sets of ears 24/64 in jaws 22 and 62 respectively. As shown in FIG. 3, this embodiment presents a set of jaws generally along the axis 12 of the whole assembly 10, but those jaws are along their own long axes 92 and 93 (see FIG. 3). This allows the jaws to converge into abutment at their meshing teeth (see ref. nos. 23 and 63 respectively), but when opened by manual operation of angled grip 68, open sufficiently to guide an object to be gripped between them.

As can be appreciated in the Figures, a very distal small gap 71 exists in front the meshing teeth 23/63 in this embodiment to allow, clamping without serrated teeth of objects or edges of objects (see small rectangular area at small gap 71 FIG. 3) by compression. Further passage of an object proximally to gap 71 allows clamping with teeth 23/63. Further passage behind teeth 23/63 allows entry into larger gap 70 and enclosure around and retainment of objects as described.

In this embodiment, jaws 22 and 62 are constantly urged together by biasing spring 56 which can be installed in a manner that urges the jaws together in a normal closed state. Angled grip 68 can be manually pulled towards the cylindrical body to open the movable jaw 26. Upon release of manual pressure to handle or grip 68 that overcomes the spring force, jaw 62 would converge to the fixed based jaw 22 for clamping action.

FIGS. 2-7, along with FIGS. 1A-G, show the basic form factor of the assembly 10. Aesthetics include a balance between approximately one-half (the end 16) with the light source and the other end 14 with the clip, gaps, and magnet. There is asymmetry in the long axis 93 of base jaw 22 being slightly offset from the central longitudinal axis 12 (compare FIGS. 2 and 3), the double-angle of long axis 92 of the moveable jaw 62 relative to the steeper angle 69 of angled grip 68 (compare FIG. 2 with FIG. 3).

A consolidated set of isometric views is shown separately in FIGS. 2-7. They portray some of the design aesthetics regarding proportion, symmetry, and the like. It also provides some dimensions for scale. Essentially, each assembly 10 can be just a few millimeters wide and just a few centimeters in length. The angled handle 68 and magnet 50 allow alternative mountings by clamping or magnetic "sticking" or attraction (e.g. to a ferromagnetic surface or material). Otherwise, when not mounted to an object, assembly 10 can be manually held and pointed to direct light from the LED which emanates generally along axis 12.

FIG. 1C gives more detail on how the housing halves might be snapped/mated together and a lens 30 installed over their open end to encapsulate LED 32. It also shows an example of a torsion spring 56. A small torsion spring 56 is installed around pivot pin 26, with one free spring arm abutting the inside side of moveable jaw 62 proximally to the pivot axis 27 of pin 26, and the other free spring arm of torsion spring 56 abutting the inside of base jaw 22 on the distal side of pin 26. The angle between those free arms is smaller than the angle between base jaw 22 and angled grip 68 when jaws 22 and 26 are closed. This causes torsion spring 56 to always urge jaws 22 and 62 towards the closed position. A user, pressing on angled grip 68 (in a direction towards base jaw 22) with enough force can overcome the spring force of torsion spring 56 and open jaws 22 and 62. Other ways of resiliently biasing the jaws are possible.

Figure 1A:
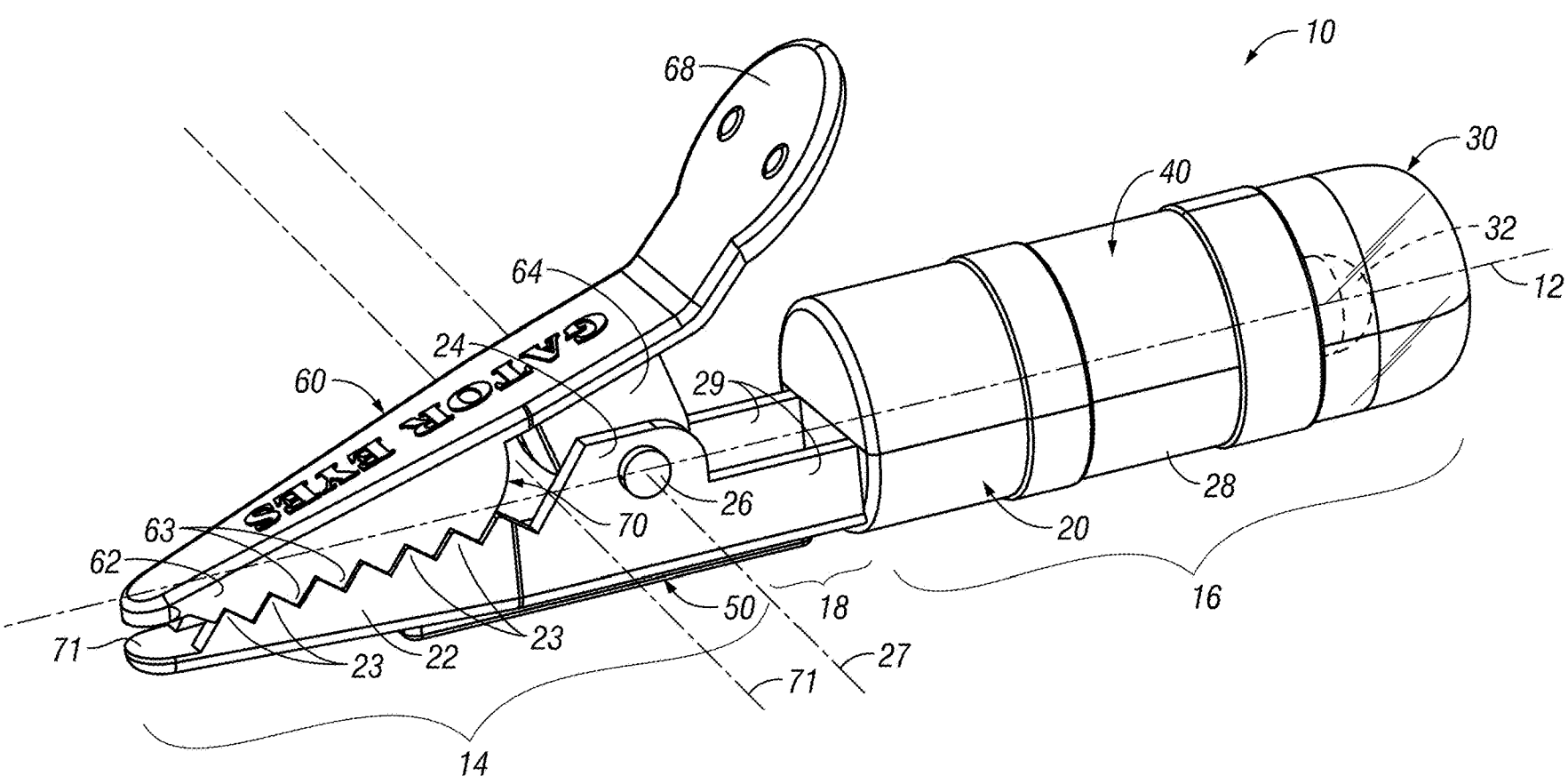
FIG. 1A is a perspective view of an individual assembled multi-use tool according to one specific embodiment of the invention.
Figure 1B:
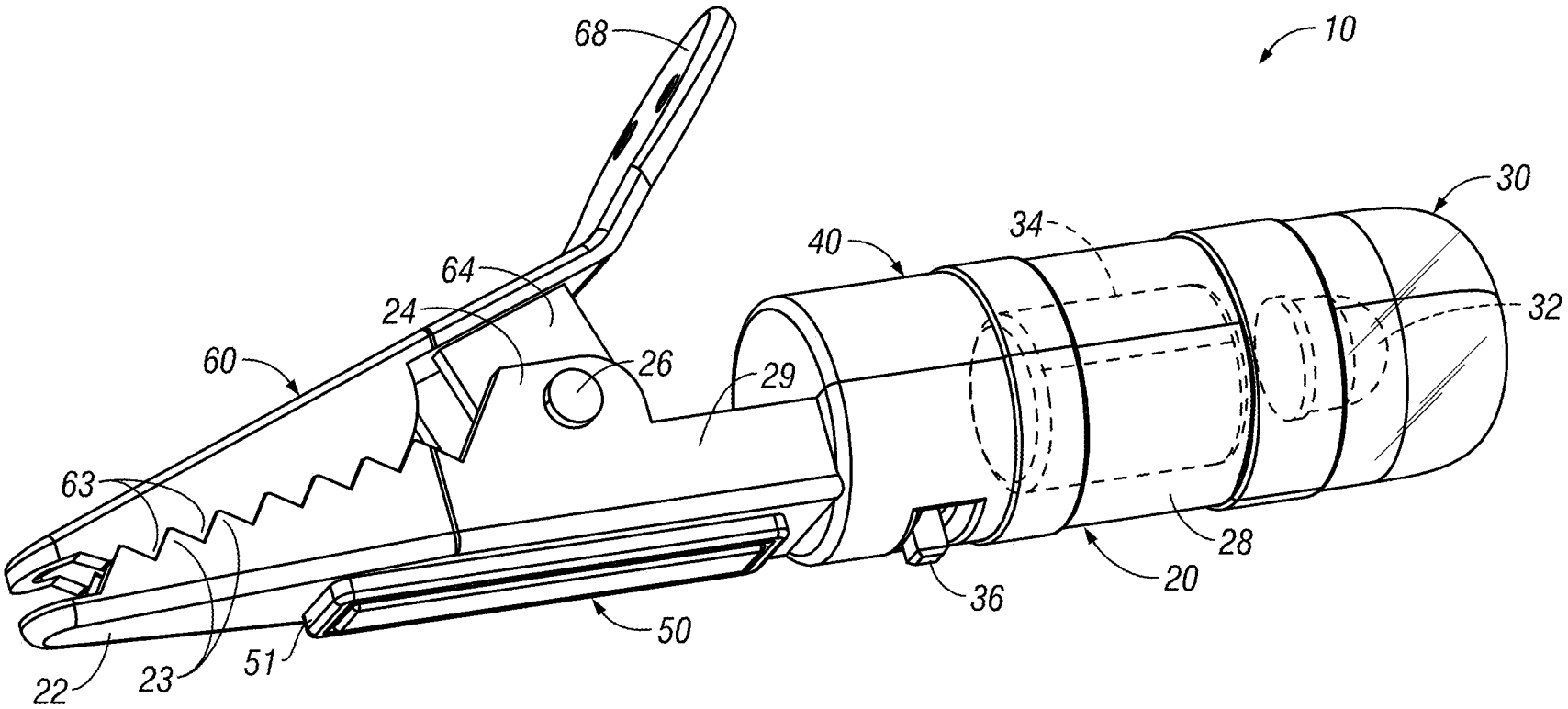
FIG. 1B is a perspective view of the embodiment of FIG. 1A from a different viewing direction.
Figure 1C:
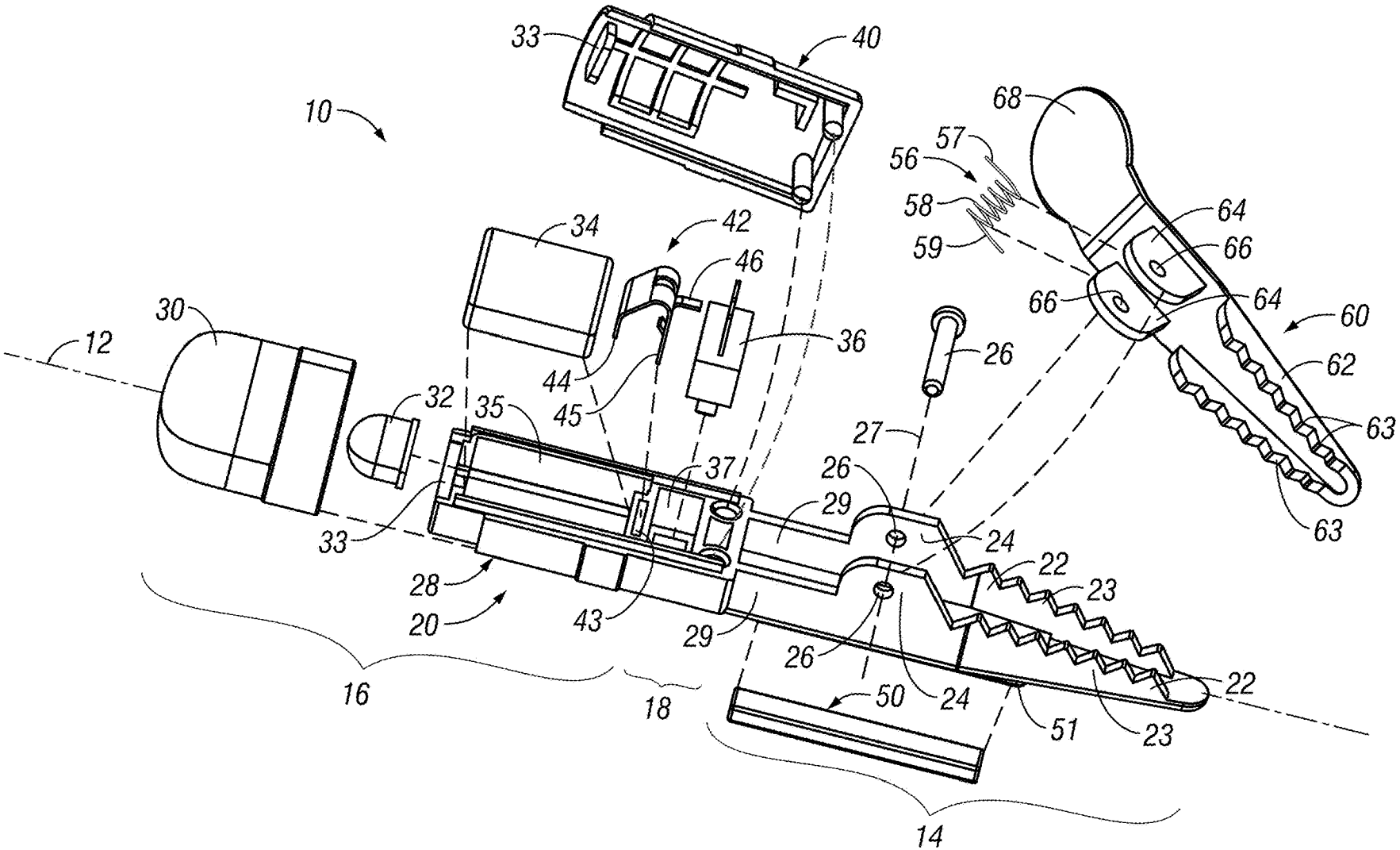
FIG. 1C is an exploded view of the assembly of FIG. 1A.
Figure 1D:
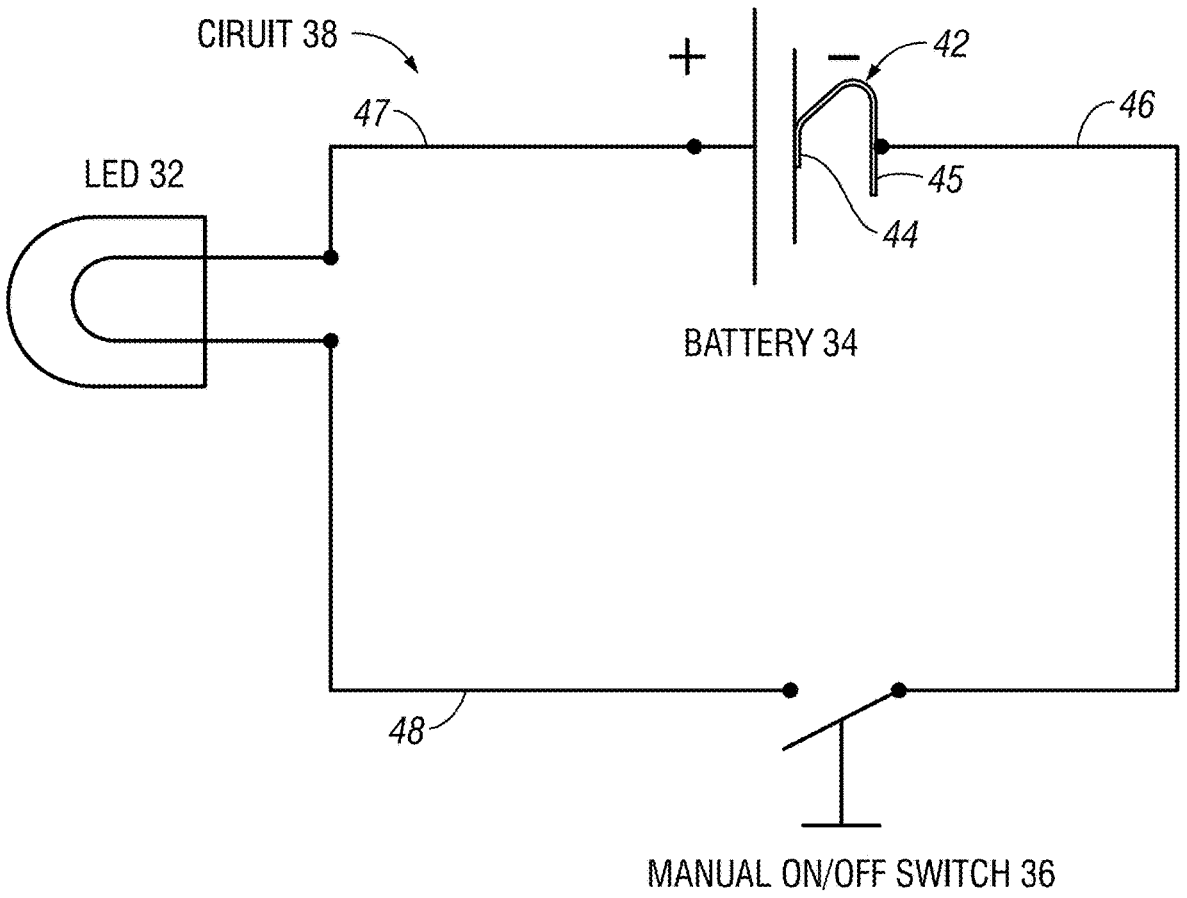
FIG. 1D is a circuit diagram of an electrical lamp circuit for the embodiment of FIG. 1A.
Figure 1E:
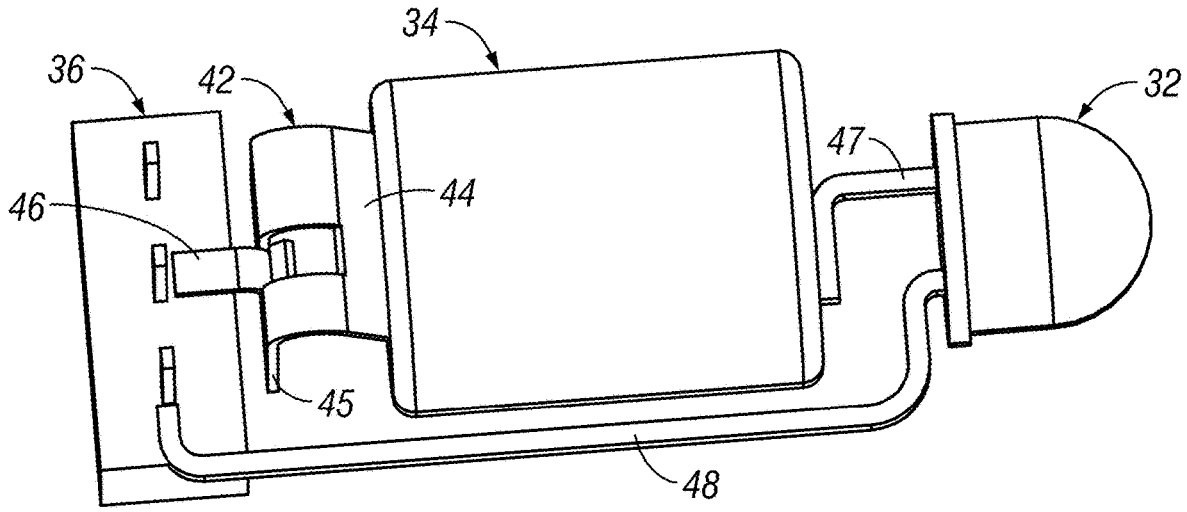
FIG. 1E is a perspective view of how the circuit of FIG. 1D is implemented into the embodiment of FIG. 1A.

FIG. 1D is a schematic diagram of the circuit 38 used for embodiment of FIG. 1A.

It is to be understood that certain parts of assembly 10 can have the following characteristics:

a. Clip End 14

Roughly ⅓rd the length of the whole assembly is teeth 23 and 63 occupying much of the jaws' facing surfaces (and they can intermesh in complementary fashion as shown). However, as shown in the Figures, gap 70 near the pivot point allows insertion of objects of thin cross-section to be placed transversely through gap 70 and behind teeth 23/63. This completely surrounds the cross-section of that object (e.g. branch, rope, rod, key ring, D-ring, carabiner, dog collar, strap, etc.) and retains the whole assembly 10. Also, if the cross-section of the object is larger than the diameter of gap 70, the jaws 22 and 62 would remain opened and torsion spring 56 would provide clamping action against the object, which would resist sliding of the assembly 10 along the axis of that long object. Thus, the clip can be used to grab something as thin as a sheet of paper but also be clipped to something such as an electrical cord. A free space behind the pivot pin 26 (between it and battery cover 40) allows room for the angled handle 68 to move towards the cover 40 for a range of opening of the jaws. On the other hand, it defines a mechanical stop at the cylindrical housing so that the jaws are not over-opened.

In this embodiment, the teeth 23/73 of the upper and lower jaws abut and mesh when in normally closed position (FIGS. 1A, 1B, 3-7, and 9A-F). Exact meshing is not necessarily required, nor are the teeth. Any clamping or clipping action is possible. In this embodiment angled grip 68 is oblique to the top of top jaw 62 and thus more accessible for manual depressing as well as allows a larger opening angle for separation of the jaws than if aligned with the plane of the top of top jaw 62. Also, the hinge pivot ears 24 and 64 of base and moveable jaws 22 and 62 extend a distance away from the generally longitudinal axes of the jaws (see FIG. 3) to create the angle between axes 12 and 92 in FIG. 3.

b. Mini-Light End 16

As indicated, cover piece 40 and base portion 28 that together make a housing for battery 34, switch 36 and light 32 can be thermoplastic. A variety of moldable plastics are possible so long as they meet the basic needs of sufficient strength and robustness. Other materials are possible.

One feature of this embodiment is balancing material costs, appearance, and structural integrity of the plastic pieces. As best seen in FIG. 1C, lower and upper jaws 22 and 62 have spaced apart walls separated by open areas between. This is carried through the hinge and to the transition 18 (see ref #s 29 at FIG. 1C) between the clip end 14 just interiorly of pivot 26 and the light end 16. The essentially U-shape-in-cross-section configurations save material and weight. But as with U-channels used in construction or in a variety of structural members, the U-shape-in-cross-section provides structural robustness that resist deformation or breakage, including at transition points between parts of the apparatus.

One skilled in the art will appropriate the precise configuration of the molded parts can vary according to desire or need. Below are several non-limiting features of this embodiment.

A metal pivot pin 26 can have one end with a widened head and then a widened cap, nut, or fastener adapted for interference fit or otherwise fixation to the other end of pin 62 once it is passed through aligned apertures through the ears of the top and bottom jaws when assembled to hold them in place relative to one another.

A trough or depression 51 can be molded into the bottom of bottom jaw 22 to receive magnet 50 by interference fit, adhesives, or otherwise.

Compartments can be molded to receive in complementary fashion to battery 34 and switch unit 36 in housing half 28, along with necessary components to complete an electrical circuit between switch 36, battery 34 and LED 32 when assembled.

c. Assembly

Figure 8:
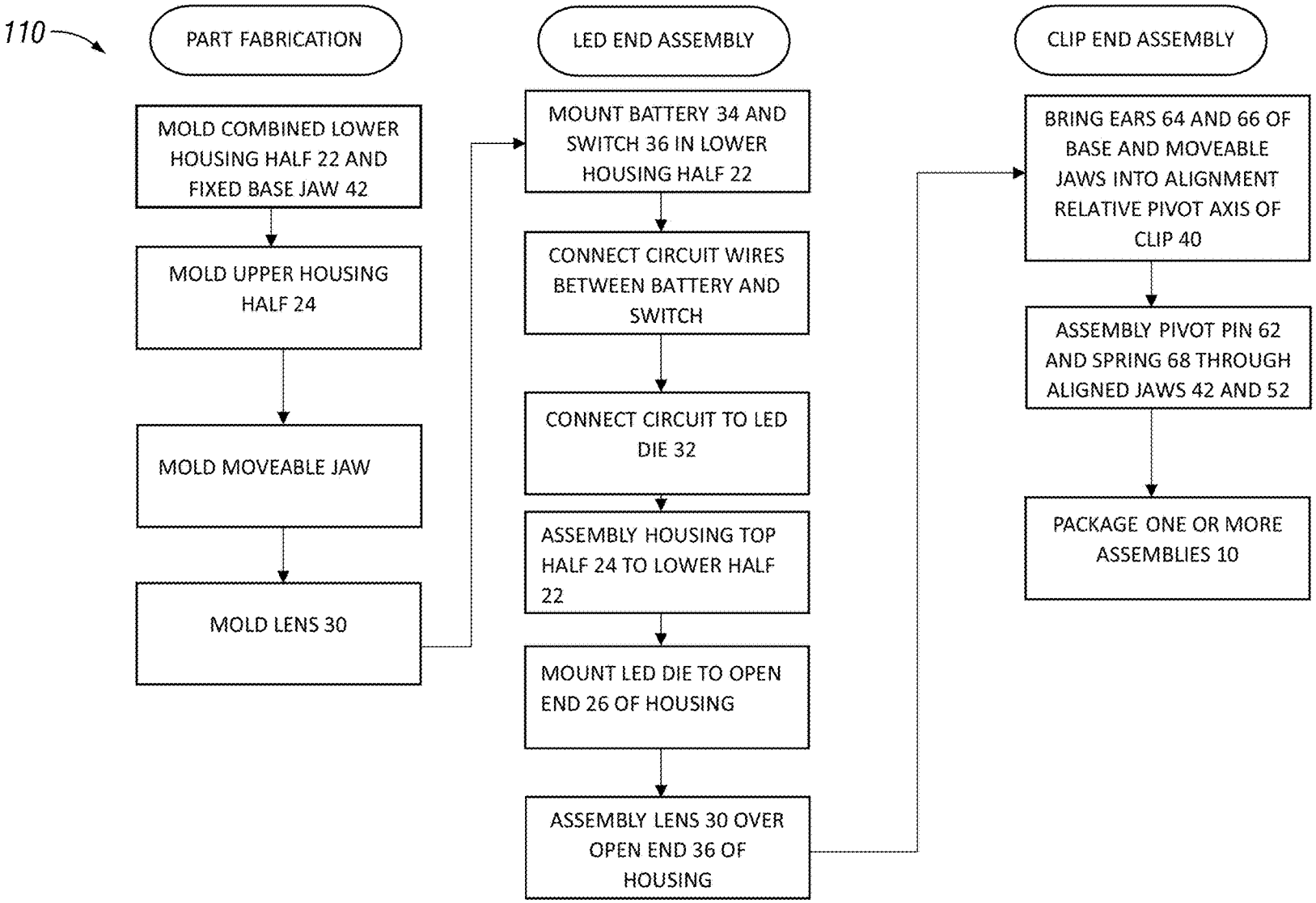
FIG. 8 is a summary of one example of a manufacturing and assembly method for producing the assembly of FIGS. 1-7.

For one example of assembly, see flow chart 110 FIG. 8. Others are, of course, possible.

In specific embodiment 10, the lower cylindrical housing section 28 and base jaw 22 are molded together. Top housing portion 40 and moveable jaw 60 are separately molded. The lens 30 is purchased or molded. By appropriate interlocking, or complementary features, the LED die 32, battery switch 36, and battery 34, along with associated wiring to create the basis circuit 38 can be installed in the lower housing half 28 and then the upper half 40 snapped or otherwise fit to the lower half 28. When piece 40 is assembled to portion 28, LED die 32 and its mounting shelf 33 cover at least a substantial portion of the open end of that housing. The opposite end is closed. This basically encapsulated the electricals of assembly 10. The lens 30 is snapped over LED 32 and the open end of the housing, encasing the LED circuit.

The moveable jaw 62, spring 56, and pin 26 are assembled, to complete clip end 14.

The magnet 50 is interference-fit or otherwise fixed in place in its receiver 51 along the side of lower jaw 22.

As can be appreciated, the color of the housing and clip can be same (such as green), but it is not necessarily required. The lens can have different optical qualities from clear to frosted. The LED can be white light or different colors.

Several features are important in the design of device 10. First, the rounded light cover or lens 30 that aligns with the LED light and fits perfectly over a round barrel at the open end of assembled portions 28 and 40 house the electrical system and batteries. This barrel is manufactured in two pieces 40 and base 20 in a mold that snap together forming a permanent one-piece constructed light. An alternative is a light which is sonically welded to the clip.

A raised plastic band along the outside of the barrel 28/40 is also built into the mold that adds rigidity to the barrel of the light when the pieces are pressed together. The base jaw 22 of the clip end 14 is a channel construction that gives three points of connection to the light barrel lower half 28, thus when molded as one-piece gives a very strong connection at the weakest point of the whole device 10. The top or outer side of moveable jaw 62, when mounted with pin 26 at pivot axis 27 extends towards the light end 16 from longitudinal axis 12 of device 10 at an angle to allow the clip jaws 22 and 62 to open sufficiently to separate both sets of teeth 23 and 63 as well as allowing an opening into gap 70, all without handle 68 hitting the light barrel at top cover 40. The inter-fitting of parts of this construction also allows a nearly watertight seal to the entire device 10.

Figure 1F:
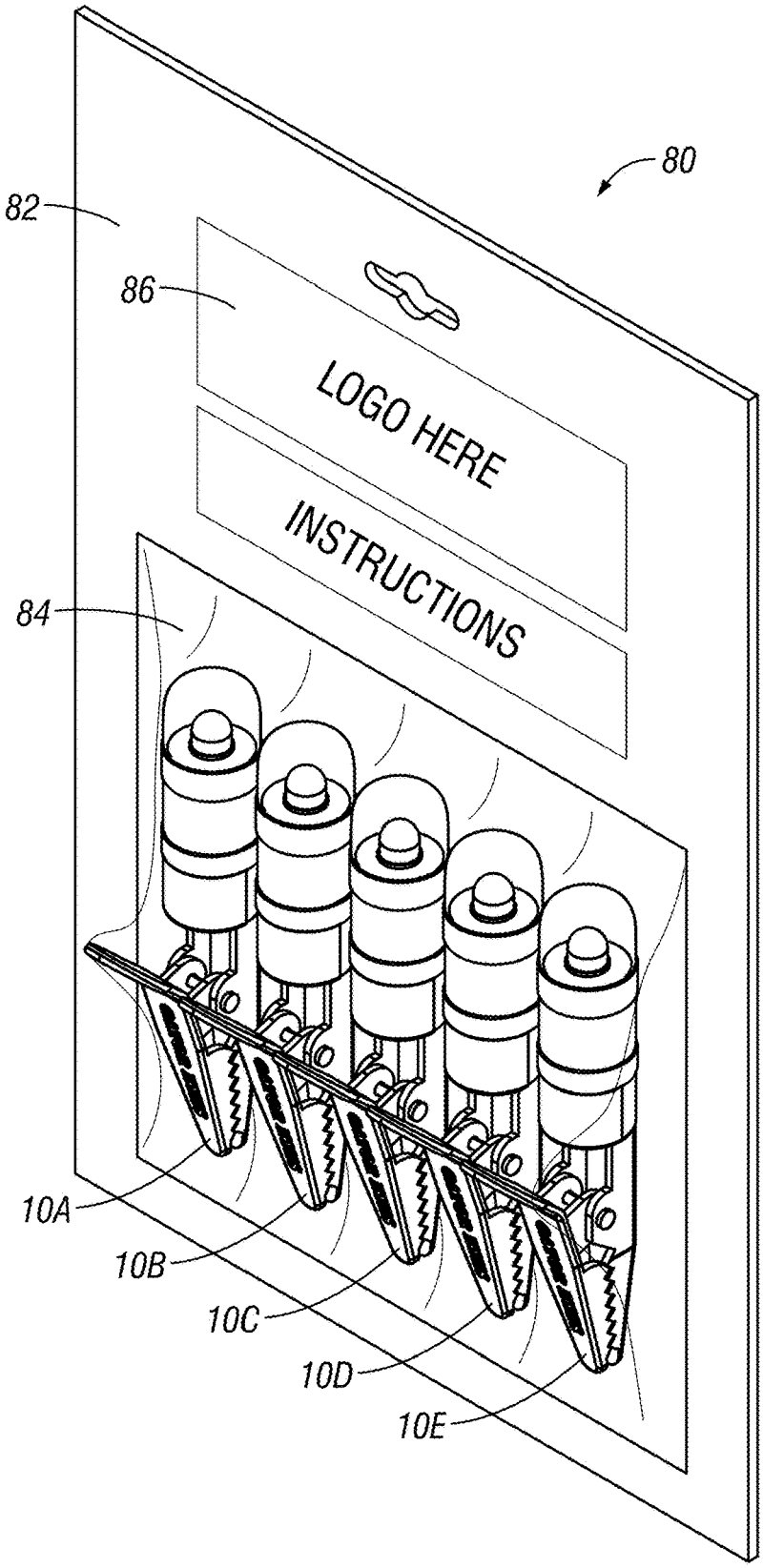
FIG. 1F is an image of a kit of plural assemblies of FIG. 1A packaged together.
Figure 1G:
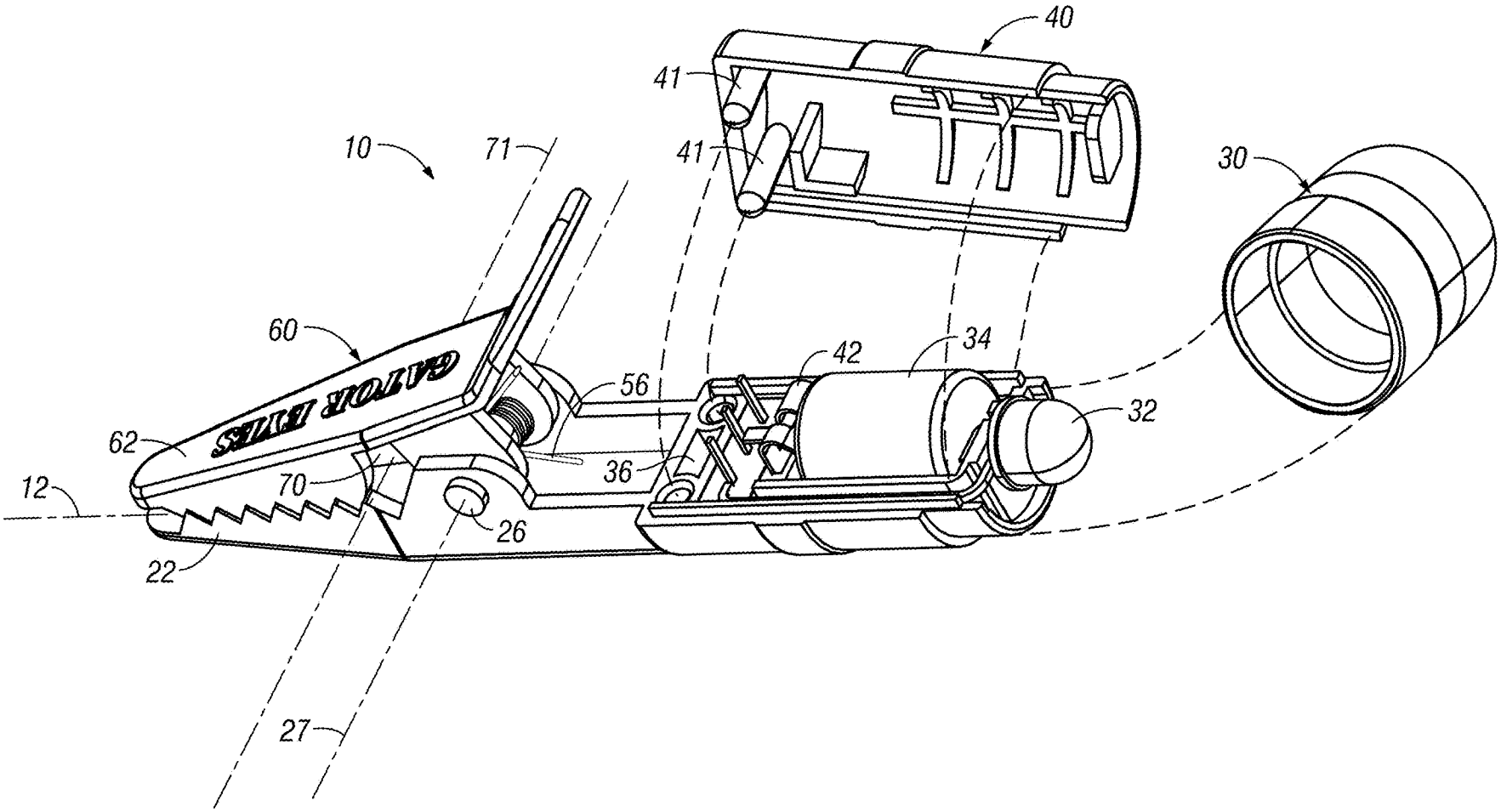
FIG. 1G is a partially exploded perspective view of the embodiment of FIG. 1A showing the assembly except the top battery cover and light lens exploded away.
Figure 1H:
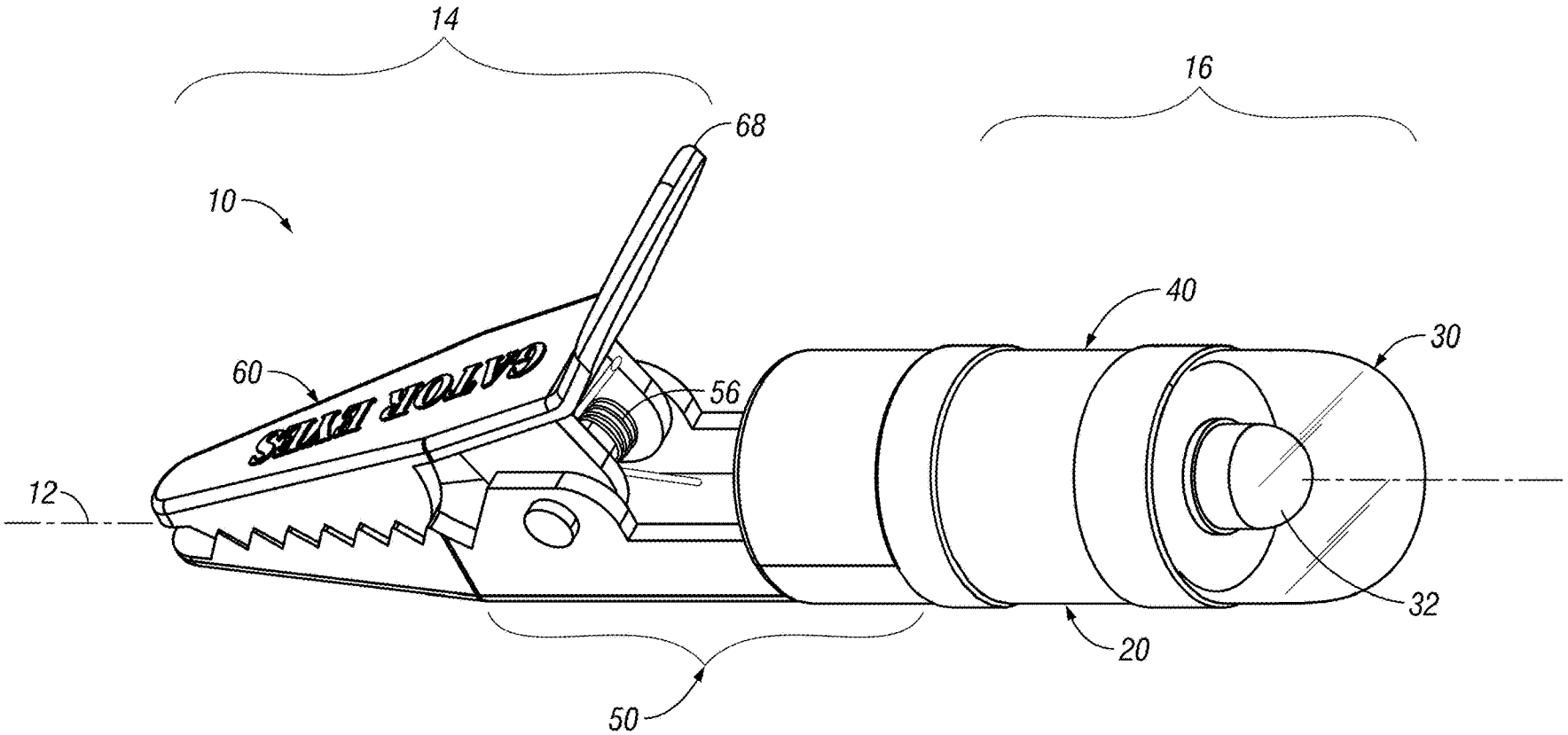
FIG. 1H is similar to FIG. 1G with the top battery cover and lens assembled in place.
Figure 2:
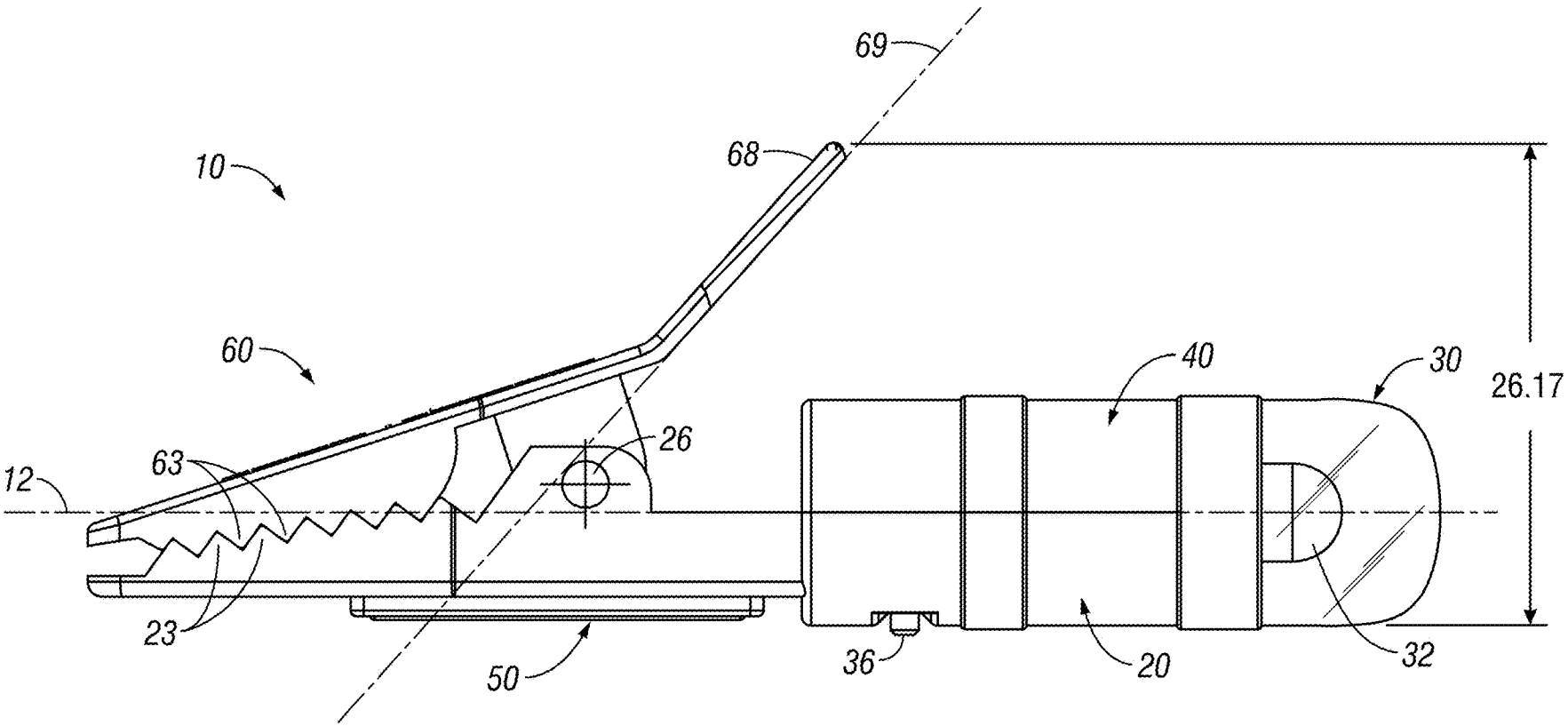
FIG. 2 is an enlarged side view of the assembly of FIG. 1A. Exemplary dimension is in millimeters.

FIG. 8 also describes that a plurality of assemblies Figures A-E can be packaged together in a kit 80. See FIG. 1F. This kit has advantages. The relatively small size of each assembly 10 (e.g. on the order of 70 mm long and 20 mm in width at the largest width from bottom of bottom jaw 22 to tip of angled grip or handle 68; the diameter of lens 30 is on the order of 10 mm or less), five assemblies 10 can be easily packaged in a 110 mm×170 mm×30 mm package. FIG. 1F shows one non-limiting example of kit 80, namely, a paper or cardboard card 82, trapping a clear plastic molded encasement 84. The card can include graphic indicia 86 such as brand name and logos, artwork, and instructions of use and the like. With five devices 10A-E in this kit example, the user has available at least that many as a starting set. And, of course, plural packages can be purchased and easily transported in pockets, backpacks, belt packs, or other portable carriers. A set of assemblies, each capable of individual tasking or collective tasking, are easy to move, use, and operate for a wide variety of task. And, the design allows relatively economical manufacture and assembly, which can translate into relatively economical purchase cost for the user for multiple assemblies or multiple kits. And the apparatus 10 can be of larger or smaller scale and proportions between components. Dimensions in the drawings are exemplary.

FIG. 1C, exploded view, shows one way the internal components of apparatus 10 can be configured and assembled. A receiver 51 can be molded to receive magnet 50 in a complementary fashion (e.g. interference fit) and/or be fixed in place mechanically, adhesively, with fasteners (not shown), or a combination of the foregoing.

The spring force member 56 to constantly urge jaws 22 and 56 together can take on a variety of forms. Non-limiting examples include a torsion spring 56 as illustrated in FIG. 1C having opposite free ends extending in generally opposite directions. Spring 56 would be mounted around pivot pin 26 between sets of ears 24 and 64 of based and moveable jaws 22 and 62 along pivot axis 27 when assembled. One extended free end of spring 56 would abut the underside of movable jaw 62 and extend on the proximal side of pivot axis 27 (the side of pivot axis away from teeth 23 and 63). The other extended free end would abut the upper side of base jaw 22 and extend on the opposite side of pivot axis 27 (the side towards teeth 23 and 63). By well-known technique, the configuration of spring 56, its characteristics, and the angle of free ends of spring 56 would constantly urge the handle 68 side of moveable jaw 62 up and away from base 20 on the interior side of pivot axis 27. This would, in turn, constantly urge the distal end of movable jaw 62 and its teeth 63 towards base jaw 22 of base 20 and its teeth 23 (the position of FIG. 1A, sometimes referred to as the closed position or closed state of the jaws).

In this embodiment, spring 56 has the following characteristics:

Sufficient clamping force to hold at least notes, pictures, gloves, hats, and the like. Durability and repeatability for at least hundreds of openings and closings. The designer can use springs with more or less clamping force.

It will be appreciated that other biasing techniques than a torsion spring as possible. Non-limiting examples include a compression spring stretched between top and bottom jaws 62 and 22 on the distal side of the pivot axis 27, or a band spring or resilient pad between top and bottom jaws 62 and 22 on the interior side of pivot axis 27.

LED 32 would be seated in the open end of barrel or housing 28/40 but at least its distal end would extend beyond it. Lens 30 would be assembled over LED 32 and fit in a complementary fashion over the proximal assembled ends of barrel or housing pieces 28 and 40 to hold those pieces together at that end. LED 32 would extend a distance away from those pieces so that it could be directly viewed from any viewing direction looking along axis 12 towards apparatus 10 from away from apparatus 10 to a plane orthogonal across axis 12 through LED 32. But further, because the crown of LED 32 extends beyond the open end of pieces 28 and 40, at least a portion of LED 32 can be viewed directly from 360 degrees around axis 12 for at least some viewing angles on the apparatus side of an orthogonal plane across axis 12 through LED 32. Still further, lens 30 can be transparent or at least substantially light transmissive for efficient emission of light energy out of apparatus 10. But because at least some light will be refracted or totally internally reflected at the surfaces of lens 30, a level of luminance will be created inside and at lens 30. Because lens 30 extends a distance away from barrel or housing 28/40, this luminance will allow visual recognition of apparatus 10 from almost any viewing direction to apparatus 10, which can be valuable when operating the LED 32 as a fiducial or marker light.

FIGS. 1D and E show how the electrical circuit 38, switch 36 and LED can be connected and operated. In this non-limiting example, circuit 38 (see e.g. 10 1D) which would primarily include a ST/SP switch 36, would complementarily seat into bay 37 molded in body portion 22. Battery 34 would likewise into molded bay 35. A formed metal clip 42 has a flat leg 45 with electrical connection 46 which would seat into molded slot 43. Opposite flat leg 44 would extend into battery bay 35 and be exposed to one pole of battery 34 when it is fit into bay 35. Wire 47 from LED 32 would be routed to one end of battery 34. Wire 48 from LED 32 would go to one terminal of switch 36. Wire 46 would be connected between the other terminal of switch 36 and the clip 42 which will be in conductive contact with the other end of battery 34. This would form a switchable circuit between switch 36, battery 36, and LED 32 in apparatus 10. All these components can be removed and replaced if the housing halves 28 and 40 are not permanently joined. It is to be understood, however, that permanent joining is possible. With the power efficiency of LEDs and use of an appropriate battery, the effective operating time of LED 32 could be cumulatively many hours, if not days, if not weeks or even months. Therefore, in some embodiments, all components of apparatus are essentially permanently assembled. The effective operating life of the LED and battery can be sufficiently practical that consumers would utilize apparatus 10 as basically a throw-away product. But in other embodiments, techniques (e.g. reversible fasteners such as screws or bolts/nuts) could be used to allow replacement of battery 34 for example.

d. Operation

Once assembled, in one state prior to use the switch would be in an opposition such that the LED is off and does not drain the battery. The spring urges the alligator clip jaws closed as in FIG. 1A.

1. Mini-Light Functions

One of the multiple functions of apparatus involves an on-board light source. In another state, switch 36 is manually turned on to turn the LED 32 on. In this embodiment its output distribution pattern is basically cone-shaped along the long axis 12 of the assembly 10. This can be varied according to selection of the LED and/or lens. In this state, the entire assembly can just be manually held by fingers and pointed or placed where the user desires or needs.

In one example, it can be used for task lighting by pointing it at the task to be eliminated. The small form factor can allow to be put in very tight surroundings.

Alternatively, the self-contained switch-on unit can be simply placed almost anywhere. One example is for hunters that are following the blood trail of a deer or other game they may have shot. Because time is of the essence to follow the game, individual assemblies can be dropped at the turned on as the hunter moves as along that trail. Individual assemblies can be used to illuminate the path to follow the blood trail. The hunter then has individual spaced apart operating light sources to return to original position the hunter started from. Apparatus 10 can be used as a fiducial or marker for visual recognition, especially at night or lower light conditions, but not limited thereto. A set of apparatus 10 (two, three, four, or more) can be used to mark a path for a substantial distance. The relatively low cost of each apparatus 10, the ability to flexibly place or mount, the use of light, and the ability to have direct view of the light or its luminance from almost any viewing angle, in combination promote this effectiveness.

Similarly, the combination of multi-functions of apparatus 10 promote effectiveness for other applications. One example is as a task light. The flexibility of mounting (clamping action of distal ends of jaws 22 and 62, retaining action of opening 70, magnetic attraction of magnet 50 provide a vast number of options of how to use light source 32 for illumination. In this embodiment, the light output intensity, distribution pattern, color, and other characteristics provide, in a very small form factor, an effective task light for many applications. But, further, the ability to utilize different modes of mounting adds to that effectiveness. The user does not have to hold and aim the light manually during a task. And, if more light is needed, two, three, or more additional apparatus 10 can be used for task lighting illumination together. The relative economy of making each apparatus makes this practical. A kit of five apparatus packaged and sold together might cost less than a single off-the-shelf flashlight.

As can be appreciated, there are other functions for the kit of FIG. 1F, or more than one kit. The combination of components can be relatively economical such that each assembly 10 is basically disposable or does not entail substantial cost if left or lost.

As can also be appreciated, the overall design allows a light source with aiming axis at one end. With fixed jaw 22 and movable jaw 62 at the other end of the device 10 along longitudinal axis 12, and with the easily accessible and operable angled handle 68, the user to almost intuitively know the beam direction. In other words, the angled handle helps manual opening the jaw but also helps the user to know where the other end is and the orientation of axis 12 in space, so aiming the beam from the LED is tactilely intuitive. The jaws 22, 62 along the other end of the device likewise provides almost intuitive opening of the jaws just by tactile feel at the clip or handle 68. The user also intuitively understands that moving and opening the jaws in one direction along axis 12 and clamping those jaws to an object results in a beam path for the light source in the opposite direction along axis 12.

2. Mounting and Retaining Functions

As mentioned, the different gaps engineered into the jaws allow flexibility as far as where and what the jaws are mounted to or grip (see FIG. 1A). See also FIG. 3 which shows that large gap 70 proximal of teeth 23 and 63 can be made a variety of sizes according to need or desire. In that example, ornamentally of at least the moveable jaw 62 can simulate an animal, here an alligator head. But it is emphasized that the multiple functionality of the gripping teeth 23 and 63 of jaws 22 and 62 in combination with the different function of encirclement of an object at gap 70, provides subtle but valuable options to the user at the clip end 14 of device 10.

The magnet 50 has a length also gives good magnetic strength and substantial exposed surface area but also flexibility as to mounting. Again, since it is elongated along fixture on it intuitively allows placement plus aiming of the light beam.

Non-limiting examples of use of clip or magnet include:

1. Hats, pockets, clothes
2. Fishing poles
3. Trails (marker lights—use plural mini-lights to mark trail by turning on and dropping on ground along trail or clamping to bushes or branches)
4. Hunting blinds
5. Dog collars
6. Cars
7. Tools
8. Panels, sheets, boards that fit between the jaws when fully opened
9. Trees & bushes.

As will be appreciated, this subtle variety of different mounting functions in apparatus 10 also adds to the effectiveness of the device. For example, some situations present a ferromagnetic surface or object for quick and easy magnetic mounting (as well as easy adjustability of the aiming direction of apparatus 10 when mounted). Whether a refrigerator cabinet, a car body, a metal pole or fence post, a metal household fixture, a metal ladder, or other, this function provides high flexibility.

Figure 10H:
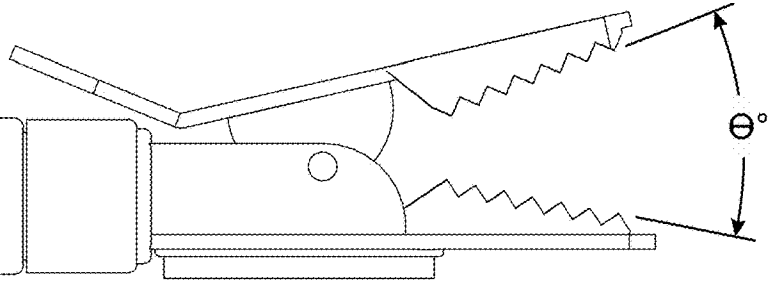
Figure 10J:
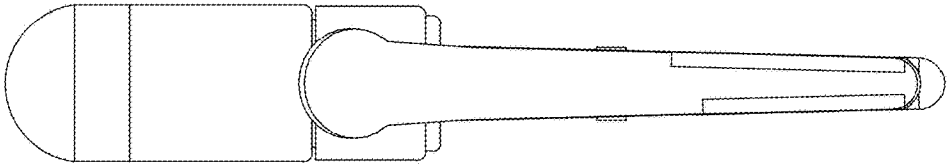
Figure 10I:
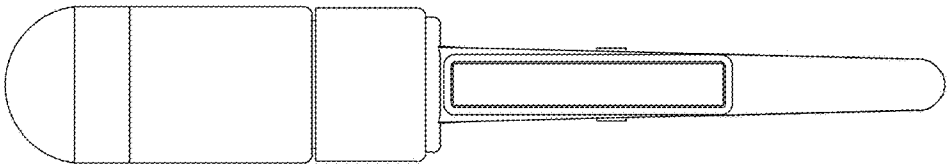
Figure 10K:
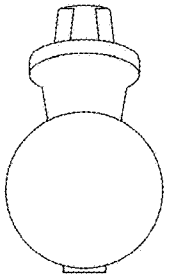

The clamping action of jaws 22, 62 is another. It is limited primarily by what can fit between the fully opened jaws 22 and 62. And the small size and weight of apparatus allows for a high degree of selection as to placement and aiming. Whether a hat bill, a fold or edge of clothing, a or edge of clothing, a panel, a tree branch, or other, this function provides high flexibility. In FIG. 10H an opening angle of ø degrees is illustrated, where ø can vary according to design, but FIG. 10H gives an example of such an angle.

The retaining action of gap 70 between proximal ends of jaws 22/62 is another. It is primarily limited by what can fit through or into gap 70 when jaws 22 and 62 are closed but deters movement of such an object in any direction except substantially along an axis through the gap. It can even deter movement of such objects as rings (e.g. key rings, D-rings, etc.) or collars that are fastened in a closed loop, or analogous objects along that transverse axis when jaws 22 and 62 are closed. Because gap 70, when jaws 22 and 62 are closed, is essentially bounded by edges of jaws 22 and 62 that define the perimeter of the gap, these edges act as mechanical stops against movement of the portion(s) of the retained object that come into abutment with any part of those edges.

In some cases, pulling of a retained object in gap 70 substantially in the direction of the meshed teeth of jaws 22 and 62, if with sufficient force, can cause jaws 22 and 62 open by overcoming the spring force urging them closed. But depending on the cross-sectional diameter of the part of the object retained in gap 70 and the specific direction and amount of force, the edges of gap 70 provide resistance against movement out of gap 70 in almost any direction. In particular, the farther the direction of movement is away from meshing teeth 23 and 63, the retained object will tend to contact edges of either jaw 22 or jaw 62, or the closed proximal part of gap 70 towards hinge pin 26. In all those cases, there is a robust mechanical stop. The force required to continue to move in such directions after abutment with the edges would need to be more than the breaking or fracture force for the material of jaws 22 or 62 or breaking or fracturing the material at or around pivot pin 26 or cause pin 26 to separate from apparatus 10.

3. Combinations of Functions

Another subtle but valuable feature of apparatus 10 is the flexibility of having available all the different multi-functions of tool 10. The user can use just one at a time. The user could use any two at a time. The user could use three or all at a time. The user could use two or more serially in time. For example, the light could be used as a manually held and aimed task light for illumination purposes. The light could later be used as a marker or fiducial. The clamping jaws could be used to hold a note with apparatus 10 just laid on a desk or table. The jaws could hold a bolt or other fastener and the user manually manipulate apparatus 10 to move the bolt or fastener to a desired position. The jaws could clamp a stack of sheets together. The retainer could receive several key rings and hold them together. It could also provide some clamping action for objects of cross-sectional area in some part larger than the area of gap 70 or dimension across it. The magnet 50 could be used to hold a note or picture on a refrigerator cabinet.

But, importantly, the apparatus gives the potential for concurrent use of any combination of the multi-function capabilities of apparatus 10. For example, a ring of keys could be retained in gap 70 while a note is clamped in jaws 22/62, while apparatus is magnetically mounted to the door of a locked automobile and the LED is turned on to allow a person to easily find the keys, even in the dark or in low light by seeing the illuminated LED 32, and receive pertinent information on the clamped note, and acquire and use the keys to open the car, and use the LED to task light the reading of the note and unlocking of the car. Similarly, the clamping jaws could clamp apparatus to a branch near a hunting tree stand, retain a D-ring or carabiner to which is attached a small bag or container with relevant contents, and leave the LED on to allow another person to easily find it including in low light conditions, and then use the light as a task light to climb to the tree stand.

Of course, a subset of functions is possible. A note could be clamping in the jaws and magnetically mounted without use of the retaining function of gap 70 or LED 32. A set of keys on a key ring retained in gap 70 could be magnetically mounted without use of the clamping function or the LED. The clamping action could be used to mount apparatus 10 to cap bill and the LED turned on for a marker or a task light without use of the magnet mount function or the retainer function. The retainer function could be used to mount apparatus 10 to a dog collar and LED 32 turned on to help locate the dog especially in low light without use of the clamping or magnetic functions.

And, of course, a subtle benefit of apparatus is to have all the multiple functions available. The user has one economical, small form factor device with any of these multiple capabilities. This enhances the value and practicality of apparatus 10, as well as having a set of apparatus 10, to provide desired or needed functionality(ies) at any time and any situation. One day the cap-mounted clamping function and LED task light could be useful. The next leaving a note on a refrigerator cabinet with the magnet mount. The next is a dog collar light with the retainer function and LED.

FIGS. 9A-L show a similar embodiment to that of FIG. 1A from perspective and isometric views. Dimensions of some aspects of apparatus 10 are shown to give the reader a better understanding of one example of the size and proportions of this embodiment. Variations are, of course, possible. These FIGS. 9A-L also show an aesthetic appearance of the clip side of apparatus 10 having an abstract alligator-like appearance with the normally-closed serrated jaws evoking alligator jaws and either the opening behind the normally-closed jaws or the pivot pin evoking alligator eyes on opposite sides, and the remainder of the device, the battery and light side, evoking an elongated alligator body. Thus, the overall apparatus evokes an alligator head and body.

FIGS. 10A-L are similar to FIGS. 9A-L but illustrate the top jaw hinged up and away from the lower fixed jaw to at or near a fully opened state, which could be controlled by manually pressing the tab at the in-board/proximal end of the hinged jaw towards the body of the apparatus with enough force to overcome the spring force constantly urging top jaw towards normally-closed position.

As will be appreciated by reference to the Figures, apparatus 10 has an aesthetic appearance that evokes an alligator. The jaws evoke an alligator snout and teeth. The following portion, at and around the jaw hinge evoke the remainder of an alligator head. The final portion evokes a follow-along alligator body or porting thereof. The aesthetic is relatively abstract but visually evocative of an alligator.

It can therefore be seen that Embodiment 1 meets or exceeds one or more of the objects, features, or advantages of the invention. It provides a multiple function tool assembly of high flexibility, economy, and subtle interoperability between functional options.

C. Second Exemplary Embodiment

FIGS. 11A-D through 24C illustrate another exemplary embodiment 10' according to the invention. As will be appreciated, many of its functionalities are similar to the first exemplary embodiment discussed earlier. Significant differences are as follows.

As can be seen, a first distal section of clip 14' has a linear section of mating teeth 23' and 63'. An open area or gap 70' is intermediate that linear abutting tooth section and pivot pin 26'. The main difference is that this opening or gap 70' also has serrations or teeth 72' formed on movable jaw 62' and the fixed jaw 22' essentially all around that opening. This adds an additional gripability feature, if this gap area 70' is used to grip an object or objects with clamping force, but it also can help a retaining function.

Further, opening 70' is substantially bigger than gap 70 of the first embodiment and has the following features. First, a substantially oblong shape between planes P1 and P2 that is roughly as long end-to-end (see length L in FIG. 12) along the longitudinal axis of jaw 62' of the apparatus 10' starting behind the distance D along the abutting teeth 23' and 63' of the distal portions of the jaws 22' and 62', but a height H of that oblong opening that is only roughly one-half as the length. This allows not only more regular-in-cross-section shapes like circles, squares, triangles, hexagon (e.g. key rings, D-rings, rods, twigs) to be retained in gap 70' (so long as the greatest dimension is less than H), but those more elongated in one direction (e.g. straps, collars, and the like) (again so long as the perimeter of the cross-section of the object fits within the area of gap 70'). Additionally, much of the inner edge E (FIG. 13) of the opening 70' has teeth or serrations. This can assist in holding items smaller in cross-sectional-area than the area across the opening 70' in place. Additionally, a subtle but important feature is that the edge portion E1 (Front) (see FIG. 13) at the distal end of the opening 70' (and roughly along plane P2) is above (dorsal) and essentially transverse to and even close to perpendicular to the fixed bottom jaw 22' or long axis 12' of apparatus 10', and parallel to plane Pin FIG. 13. This front edge portion E1 (Front) of gap 70' essentially acts as a mechanical stop against movement of whatever is contained within opening 70' from leaving or being pulled out opening 70' in the direction of the distal ends of the jaws (in a direction towards a plane P2 in FIG. 13, where planes P1 and P2 are generally perpendicular to the plane of FIG. 13). FIG. 22 diagrammatically illustrates that even if a retained object (e.g. key ring) is moved or urged in any of directions F1, F2, F3, F4, or F5, it will hit the mechanical stop at edge E front section E1 (FIG. 13) which will resist movement of the ring out of gap 70'.

Additionally, the slight gap 71 at the very distal ends of the jaws in the first embodiment in not used in this embodiment (although it could be).

Embodiment Two includes magnetic insert 50' along fixed jaw base 22', a housing 28'/40' for the battery 34' and switch 36', and LED light source 32', where LED 32' is then covered by a light transmissive cap or lens 30'. As can be appreciated, LED 32' has its distal portion exposed from the battery housing. This allows an almost 360° view of either the LED directly or at least the luminosity of the lens 30' when the LED is turned on. Thus, if used as a marker, regardless of how the apparatus 10' is mounted relative line of sight of a viewer, it is highly likely at least some of the luminance or illumination generated by device 10' is visible. Mounting posts 41P' on cover 40' mate into holes 4111' in base 20' to help secure that end of 40'. Lens 30' secures the other end.

This high viewing angle of the LED 32' is illustrated diagrammatically in FIG. 20. Lines B diagrammatically illustrate an exemplary possible beam output from LED 32'. This would allow direct view of the light emitted from LED 32' from a substantial range of viewing angles. Lines V in FIG. 21 indicates the extremes of viewing angles that could see at least the crown of LED 32' or a portion of lens 30'. This is a substantially larger range of viewing angles than beam B. Thus, full intensity direct viewing of LED 32' allows many viewing angles. Partial view of LED 32' gives more, while partial view of lens 30' gives even more. Therefore, almost regardless of orientation of apparatus 10', most viewing angles would see at least luminosity of lens 30' if not direct view of LED 32'. Thus, precise mounting of apparatus 30' as a marker or fiducial is not critical in most cases.

A further feature of this embodiment is the combination of functionality but with aesthetic ornamentation. The form factor of at least movable jaw 62' evokes or suggests general shape of an alligator head, including but not limited to a top profile curvature narrower at the jaws but then a taller, rounded following portion evoking an alligator head at and around the eyes. The linear adjacent distal teeth evoke or suggest the snout and teeth of an alligator. The remainder evokes an alligator body.

FIGS. 19A-D, show that aesthetic. FIGS. 18A-D further show details about the movable jaw. The moveable jaw 60' would open and close similar to jaw 60 of Embodiment 1. Exemplary but nonlimiting dimensions are shown for context. It is to be understood that any dimension shown in the figures or discussed regarding these embodiments are nonlimiting exemplary.

FIGS. 20 and 21 show how the beam and luminance of LED and lens allow illumination with the beam (see arrows B) and sight of the lens 30' from many viewing angles (see arrows V), including from not directly in the LED beam.

FIGS. 22, 23, 24A-C illustrate how device 10' can be used in a variety of ways for a variety of objects and functions.

D. Third Exemplary Embodiment

By reference to FIGS. 25A and B another embodiment according to aspects of the invention is illustrated. This embodiment 10" includes basically just the end 14 or 14' of embodiments one and two. As such, it includes a base 20" that includes a bottom jaw 22". A separate moveable jaw 60" with jaw portion 62" is pivotally attached at one set of adjacent aligned ends of jaws 22" and 62". The pivot connection can be like that of embodiments one or two.

A gap 70" is between meshing teeth 23"/63" at the other adjacent ends of jaws 22" and 62". In FIGS. 25A and B it is similar to gap 70' but could take a variety of forms. The multi-functions of clamping action and retaining action as discussed with Embodiments One and Two are thus embodied in assembly 10".

In one variation to assembly 10", a magnet 50" (like magnet 50 or 50') could be built into base 20".

E. Options and Alternatives

The foregoing first and second embodiments are but a few specific examples of aspects of the invention. As can be appreciated the invention can take many forms and embodiments. A few non-limiting examples are as follows.

1. Form factors

FIGS. 1A and 11A show that, aesthetic-wise, the movable jaw 60 or 60' or 60" could be intentionally molded or otherwise formed to simulate a top profile of an alligator head. This could include ornamentation with surface features as shown like simulating an alligator. One difference between embodiments 10 and 10' or 10" is the gap 70' or 70":

a. The teeth of the alligator clip invoke alligator teeth. Note that in the second and third embodiments 10' and 10", a larger gap 70' or 70" than 70 is used.

b. This gap 70' or 70" allows encirclement and retention of even larger objects such as rings, cords, straps, or robes but still have the converging teeth for thinner or gripping functions.

The housing or clamp surfaces could include three dimensional characteristics or indicia. Non-limiting examples are:

a. The moveable jaw (and base jaw) could simulate the appearance of an alligator head, jaw(s), and teeth.
b. One or more surfaces could include indicia such as trademarks, words, shapes, etc.

2. Materials

As can be appreciated, the materials can vary. Plastics attend to be more economical but are not necessarily required.

It will be appreciated that materials for the main pieces of the apparatus 10, 10', or 10" could be molded of plastic. One non-limiting example is Taiwan ABS. In one nonlimiting example, the plastic can be formulated so that when in final form it is relatively durable and resistant to a wide variety of temperatures from well below zero to on the order of 10 0° or even more. In one example, those molded portions are alligator green.

3. Structural Features

As will be appreciated from the drawings, in one form the main molded housing components can basically be three pieces. The movable jaw could be molded separately and then installed with its pivot pin 26, 26', or 26", which generally would be metal but is not limited thereto. If mini-light portion 16 or 16' is used, the lower jaw and lower battery housing could be a one molded piece 20 or 20'; with flanges that allow assembly with a third top battery piece 40 or 40'. This would allow adhesives, ultrasonic welding, or even use of fasteners such as screws to join the lower section 20 or 20' and that other section 40 or 40'. As mentioned, techniques known in the art could be used to seal off that juncture around the battery as well as any lens junction.

As illustrated, for strength purposes, the thickness of the neck area 18 or 18' between a mini-light section 16 or 16' and the clip section 14 or 14' (if mini-light section 16 or 16' is used) could be thickened. Alternatively, as best illustrated in FIG. 11A, a U-shaped transition could be a part of the molded piece. The molded channel at area 18 or 18' between the halves or ends 14 or 14' and 16 or 16' of the device thus present three points of contact to resist deformation or failure. This would resist snapping of breakage in any direction.

4. Resilient Bias

In a similar fashion, whatever resilient member is used to urge the movable jaw against the lower fixed jaw can be intentionally selected to be greater than might simply be effective to grip on to something. This subtle and counter-intuitive optional feature could lend benefits in functionality. For example, having higher converging pressure by that element to the jaws would improve the grip in hostile conditions or where there is a risk that outside forces could try to dislodge the device. One example would be in an outdoor environment where wind, sleet, or animals would present forces to try to dislodge it.

In one example, a torsion spring can be used to accomplish this.

A torsion spring is a spring that works by twisting; when it is twisted about its axis by an angle, it produces a torque proportional to the angle. A torsion spring's rate is in units of torque divided by angle, such as N·m/rad or ft·lbf/degree. Unlike tension or compression springs in which the load is an axial force, the load applied to a torsion spring is a torque or twisting force, and the end of the spring rotates through an angle as the load is applied. In any of exemplary embodiments 10, 10' or 10", a torsion spring 56 can be installed with its body (its coiled portion 58 in FIG. 1C) wrapped around pivot pin 26, 26' or 26". The free ends 57 and 59 at opposite ends of coiled body 58 of spring 56 extend into abutment with base jaw 22 or 22' or 22", and moveable jaw 62 or 62' or 62", respectively, and spring body 58 is always tensioned, meaning that its coils are at least partially always loaded with a torque or twisting force. This constantly urges jaws 22 or 22' or 22" and 62 or 62' or 2" together. The amount of force is dependent on the materials, size and characteristics of the torsion spring.

It will be appreciated by those skilled in the art that other techniques of constantly urging the jaws together are possible. For example, other types of springs can be used:

a. Flat spring—made of a flat spring steel or other resilient material.
b. Machined spring—this type of spring is manufactured by machining bar stock with a lathe and/or milling operation rather than a coiling operation. Since it is machined, the spring may incorporate features in addition to the elastic element. Machined springs can be made in the typical load cases of compression/extension, torsion, etc.
c. Serpentine spring—a zig-zag of thick wire—often used in modern upholstery/furniture.
d. Garter spring—A coiled steel spring that is connected at each end to create a circular shape.
e. Cantilever spring—a spring fixed only at one end.
f. Coil spring or helical spring—a spring (made by winding a wire around a cylinder) is of two types:
   1. Tension or extension springs are designed to become longer under load. Their turns (loops) are normally touching in the unloaded position, and they have a hook, eye or some other means of attachment at each end. A tension/extension spring could connected between base 22/22'/22" and movable jaws 62/62'/62" on the distal side of pivot pin—operates with a tension load, so the spring would be tensioned before mounted between the jaws in closed position to pull and hold them in abutment and then, when a load is applied to it by pressed movable jaw handle on the other side of the pivot pin, the spring would stretch and try to return the jaws to closed position.

2. Compression springs are designed to become shorter when loaded. Their turns (loops) are not touching in the unloaded position, and they need no attachment points. Compression spring connected between the base and moveable jaws on the proximal side of the pivot ping operates with a compression load, so the spring would be compressed before mounted between the jaws in closed position to push the moveable jaw handle away from the base (which would push the moveable jaw into and hold it in abutment to the base jaw on the other side of the pivot pin, and then gets shorter as the load is applied to it by depressing the handle so the spring would continue to try to push the handle away and return the jaws to abutment.

g. Volute spring—a compression coil spring in the form of a cone so that under compression the coils are not forced against each other, thus permitting longer travel.

h. Leaf spring—a flat spring used in vehicle suspensions, electrical switches, and bows.

5. Clamping Surfaces

The exemplary embodiments include teeth 23/63 or 23'/63' or 23"/63" at the main clamping surfaces. Teeth can also exist around at least part of gap 70 or 70" or 70" But teeth are not necessarily needed. A variety of clamping surfaces are possible over and above teeth.

6. Assembly

As will be appreciated, the specific ways different parts of the assembly are manufactured and assembled can vary. Non-limiting examples are:

1. Complementary ridges/slots/surfaces/bosses etc. between parts that guide them into position relative to one another.
2. Securement by adhesives, interference-fit, snap-fit, fasteners, ultrasonic or thermal welding, etc.

7. Light Source

If the mini-light section 16 or 16' is used, variations are of course possible. Non-limiting examples are:

1. Type
2. Color (e.g. white, yellow, green, etc., or mixture of colors in kit).
3. Beam distribution pattern
4. Intensity The examples 10 and 10' use an LED as a light source. It could be more than one. Also, it does not necessarily have to be an LED. An incandescent source or other types are possible. As will be appreciated, the light source can have characteristics according to need or desire of the designer.

It can be further appreciated that the LED can have any of a different variety of colors. In one example, it could be white light. In another, it could be red, blue, green, or any other visible color that can be generated by LEDs and it is not necessarily limited just to visible light. Some LED emissions go outside the visible range.

Furthermore, the lens can be transparent or clear. It could also have some portions that are less than 100% light transmissive. For example, it could be clear at the distal end along the LED output axis but frosted or diffusive and around the sides. Alternatively, the whole lens could be less than 100% transmissive. Some could be diffusive.

Still further, coordination of the light output of the LED and the nature of the lens can work together. In some examples a certain wavelength LED light output could be modified by a coating or nature of refraction of the lens.

Another option would be to include commercially available and relatively inexpensive circuits and/or plural LED sources to allow a user to select between color outputs out of the same apparatus 10 or 10'.

8. LED Light Output Distribution/Pattern

As indicated above, the beam spread and pattern can be selected by the designer. In this example above, it is basically at an outward diverging angle. This provides subtle benefits. One would be it is somewhat directional for task lighting. The amount of lumens is at least in the range of being effective for many task lighting tasks even though coming from a single and small source. On the other hand, its output distribution pattern provides direct line of sight intensity at substantial distances over quite a range of viewing angles to the central aiming axis of the LED. This can be helpful for simply visually identifying the device when, for example, used as a marker or way point fiducial. Still further, a balance between enough lumens for effective task lighting and wide enough beam for fiducial purposes, combined with the small form factor which limits the size and usually the storage capacity of the onboard battery, is another subtle but effective feature.

9. Lens

In one example, the lens 30 or 30' is basically hemispherical or similar in the sense that it is not only light from a transmissive along the optical output axis of the LED, which is generally along the longitudinal axis of the overall device. The lens can also cover but reveal at least some portion 360° around the side of the LED that is orthogonal to the optical axis of the LED. As best seen in FIGS. 11A and B to 13-15, this would allow not only increased viewing angle direct view of the illuminated light source from more viewing angles around device 10 or 10', by the physics of light, the admission or distribution angle from the light source will have some refraction and some internal reflection of the lens. This will induce luminosity at and around and inside the lens. As such, the end 16 or 16' of apparatus 10 or 10' at the lens will appear as a fuzzy ball of light. Thus, even though a viewer is outside the output distribution pattern of the LED that emanates out of the lens, it improves the chance from almost any viewing angle of seeing that small ball of light as luminance. This can be an added subtle advantage regarding use of the apparatus as a marker or fiducial.

It is to be appreciated that the selection of lens 30 or 30' and its features can vary according to need or desire of the designer. A non-limiting example for lens 50' is clear molded poly styrene.

10. Power Source

As will be appreciated, battery technology is improving rapidly. Even with the small form factor dimensions of the embodiments, a relatively inexpensive, common, commercially available battery (e.g. 1.5 VCS, 35 MAh) could be installed in the apparatus. The power characteristics of LEDs are such that the normal effective lifespan of LED operation with such a battery would be substantial. It typically would be on the order of days or even weeks of continuous operation. It could be even more than that the depending on environmental conditions.

It will be appreciated by those skilled in the art that more expensive batteries are possible with even longer effective lifespans. For example, some commercially-available types of batteries are purported by manufacturers to have the ability for effective powering of a single LED for months or even a year or more of continuous operation. This provides the option of such things as using the apparatus 10 as a trail marker or fiducial by mounting it at a location and leaving it in place for that length of range of time spans (e.g. weeks, months, perhaps even years) and have the probability that it will provide at least enough illumination or luminance to function effectively as that trail marker or fiducial. In one example, if a hunter establishes a hunting blind or tree stand in a secluded area of the woods. Over one or more hunting seasons, a series of these apparatuses could be mounted to mark out a path for anyone to follow to find that location. This could be particularly important in areas where cellular phone coverage is spotty or uncertain.

Specifications for one non-limited example of battery 34 or 34' are as follows:

| | |
|---|---|
| Supported battery type: | AG3 |
| Lithium battery voltage: | 1.5 v |
| Battery average life: | 4 days |
| Battery composition: | |
| Battery capacity: | 28 mAh |
| Battery size: | 3.6 mm H * 7.9 mm D. |
| Battery weight: | 0.62 gram |

11. Magnet

The magnet can be selected based on a number of factors. Non-limiting examples are:

a. Magnetic strength b. Cost c. Durability (including over weather and temperature extremes).

One optional feature could be intentional selection of the magnet to have an attraction force that is substantially higher than might normally be considered needed to simply mount the apparatus to a metal surface. For example, magnetic strength could be well higher than to be effective in that manner. Its size could be on the order of 20 mm, in one non-limiting example. This would allow the added subtle functionality of not only mounting it to a metal surface but also using it for such things as to pick up other metal or ferromagnetic members. Examples could be screwdrivers, hammers, hooks, metal fasteners, etc.

It will be appreciated by those skilled in the art that other magnet types and characteristics can be used according to desire or need. The magnet in the table above, however, provides subtle benefits, some of which are counterintuitive. Its length, width, thickness and magnetic strength are substantially larger than what is typically used or needed for refrigerator magnets. This is antagonistic with integrating it into a small-scale base 20, 20', or 20" of the embodiments as well as the added cost and weight. However, a balancing of competing factors of apparatus 10, 10', or 10" takes advantage of this in subtle ways. It allows the small apparatus 10' to have more reliable and stronger magnetic attraction. This allows more flexibility in application and placement. It also allows apparatus 10, 10' or 10" to hold in place higher masses. A typical refrigerator magnet could not hold a ring of keys on a vertical surface. Apparatus 10, 10', or 10", if it incorporates a magnet, allows both such retainment of a mass (like ring of keys, strap of a bag, etc.) but also clamping of another object or objects simultaneously in jaws 22/62 or 22'/62' or 22"/62".

It is to be appreciated that the selection of this magnet as these features with subtle benefits in the context of apparatus:

a. more magnetic strength than needed just to mount on a metal surface.

b. magnetic strength sufficient to hold against movement a key ring with at least several keys.

Non-limiting examples of a magnet can include neodymium iron boron, samarium cobalt, ceramic, alnico, ferrite, and flexible.

12. Applications

The foregoing descriptions of the embodiments includes non-limiting examples of some of the different ways the embodiments can be applied and used. FIGS. 23 and 24A-D illustrate some of those applications. Any use that is analogous to those are possible.

FIG. 23 illustrates how any of the embodiments 10, 10', or 10" that include a magnet 50. 50' or 50", could be used to mount the assembly to a metal surface, here a refrigerator cabinet 102. Several different apparatus 10, 10', or 10" could be magnetically mounted to refrigerator 102 in different orientations and using different multi-functions. One could be magnetically mounted to cabinet 102 with light 34 on. Another is magnetic mount to cabinet 102 and hold key ring 104 (with one or more keys 105) in retainer gap 70' or 70". Another is magnetic mount and hold a note 106 in clamping jaws 22/62/ or 22'/62' or 22"/62". Another is both hold a key ring 104 in gap 70' or 70" and also a picture 108 between the clamping jaws. Of course, retaining in gap 70 or 70', plus clamping with the jaws 22/62 or 22'/62', plus a task or marker light 32 or 32' (if used) is possible with magnetic mount (if used).

FIG. 23 shows the retaining of a key ring 104 when magnetically mounted to metal surface 102 (in cross section). It illustrates how gap 70' or 70" retains the ring (shown in cross section) relative the mechanical stop at plane P2.

FIG. 24A is similar but shows a strap 112 (more elongated in one-direction in cross-section) such as on flattened dog collars, book bag handles, and the like.

FIG. 24B is similar to FIG. 24A but illustrates another type of ring, a conventional D-ring 110 such as is used on back packs, small cases, and other containers.

FIG. 24C is similar but shows a small branch or twig or the like.

13. Aesthetics

The embodiments 10, 10' and 10" have an abstraction ornamental appearance of an alligator head. Alternatives are possible. For example, FIG. 26 shows that a more realistic appearance is possible, such as with an actual representative of alligator eyes 101 and perhaps representation of spine and scale features 100 as well as color.

What is claimed is:

1. A multi-function tool assembly comprising:

a. a housing having first and second opposite ends along a longitudinal axis;

b. an LED source and battery at the first end of the housing, the LED source having a light beam pattern emanating from the first end;

c. a clamp at the second end of the housing, the clamp comprising;

i. a fixed base jaw extending oppositely the first end of the housing from a proximal end to a distal end;

ii. a movable jaw with manually-operated handle pivotally connected to the fixed base jaw and extending generally in the same direction as the fixed base jaw from a proximal end to a distal end;

iii. a bias member operatively associated between the fixed base and moveable jaws to resiliently-bias the moveable jaw to a closed position at the base jaw but allow manually opening of the distal ends with the manual handle;

iv. facing teeth at the distal ends of the base and moveable jaws;

v. a gap having an area at and between the proximal ends of the base and moveable jaws when resiliently biased together adapted to retain items of cross-sectional area less than the area of gap when the base and moveable jaws are biased together; and d. a magnet along a side of the housing for magnetic mounting to a ferromagnetic surface;

e. so that the mini-light allows selective one or more of:

i. manual holding;

ii. clip-on by clamp teeth to or for objects and materials that fit between teeth of jaws;

iii. retainment at the gap for objects that fit in the gap;

iv. magnetic mount; and v. task or marker lighting.

2. The tool assembly of claim 1 further comprising an on-off switch to manually turn the LED source on and off.

3. The tool assembly of claim 1 further comprising a lens over the LED source.

4. The tool assembly of claim 1 wherein the housing and clamp are thermoplastic molded to a form factor.

5. The tool assembly of claim 4 wherein the moveable jaw simulates an alligator head.

6. A kit comprising:

a. a plurality of tool assemblies of claim 1 packaged together.

7. The tool assembly of claim 1 wherein the gap has a diameter at least on the order of ⅜ inch.

8. The tool assembly of claim 1 wherein the gap is generally oblong in shape with a long axis generally in the same direction as longitudinal axis of the body.

9. The tool assembly of claim 1 wherein the gap is partially offset from the longitudinal axis of the body in the direction of the moveable jaw.

10. The tool assembly of claim 1 wherein the gap has an inner edge comprising:

a. a ventral section comprising a length along the lower fixed jaw;

b. a dorsal section comprising a length along the upper movable jaw;

c. a proximal section comprising a length along at least one of the lower and upper jaws at or near the hinge; and d. a distal section comprising a length along the upper moveable jaw from the dorsal section towards the ventral section in a direction transverse to the longitudinal axis of the body, so that the distal section of the upper moveable jaw is a mechanical stop against movement of an object inside the gap in a direction towards the distal section of the inner edge.

11. A multi-function tool assembly comprising:

a. an elongated bottom jaw having a proximal end and a distal end along a bottom jaw longitudinal axis;

b. an elongated top jaw having a proximal end and a distal end along a top jaw longitudinal axis;

c. a hinge between the bottom and top jaws towards the proximal ends of the bottom and top jaws allowing pivotal movement of the top and bottom jaws between closed and open states;

d. a spring force member having a spring force mounted on at least one of the bottom and top jaws and operatively constantly urging the distal ends of the top jaw into abutment with the distal end of the bottom jaw in the closed state but allowing separation to the open state upon overcoming the spring force of the spring force member;

e. a gap between the bottom and top jaws between the distal ends of the top and bottom jaws and the hinge when the top jaw is in abutment with the bottom jaw, the gap having a size to surround an object with a cross-sectional area diameter on the order of ⅜ inch when the top jaw is in abutment with the bottom jaw in the closed state;

f. so that the distal ends of the top and bottom jaws provide one or more of:

i. clamping action to an object that fits between when opened towards the open state; and ii. retaining action to an object that fits through the gap;

g. a magnet mounted to one of the top and bottom jaws; and h. a light source mounted to the other one of the top and bottom jaws.

* * * * *